United States Patent [19]

Mohr

[11] Patent Number: 4,726,106

[45] Date of Patent: Feb. 23, 1988

[54] METHOD AND APPARATUS FOR FORMING A ROW OF SPRING COILS FROM A CONTINUOUS LENGTH OF WIRE

[75] Inventor: Henry G. Mohr, Carthage, Mo.

[73] Assignee: Leggett & Platt, Incorporated, Carthage, Mo.

[21] Appl. No.: 905,851

[22] Filed: Sep. 10, 1986

[51] Int. Cl.[4] ..... B21F 35/02

[52] U.S. Cl. ..... 29/173; 140/3 CA; 140/103

[58] Field of Search ..... 29/173, 791; 140/3 CA, 140/1 R, 103, 105; 5/256; 72/137

[56] References Cited

U.S. PATENT DOCUMENTS

| | | | |
|---|---|---|---|
| 264,468 | 9/1882 | Mitchel . | |
| 276,421 | 4/1883 | Jones . | |
| 315,546 | 4/1885 | Prowse . | |
| 318,092 | 5/1885 | Davis . | |
| 336,202 | 2/1886 | Bell . | |
| 406,475 | 7/1889 | Rice . | |
| 639,795 | 12/1899 | Treadway et al. | 5/268 |
| 2,072,890 | 3/1937 | Krims | 5/269 |
| 2,815,062 | 12/1957 | Cook et al. | 140/105 |
| 3,355,747 | 12/1967 | Norman | 5/252 |
| 3,541,828 | 11/1970 | Norman | 72/140 |
| 3,577,574 | 5/1971 | Ciampa et al. | 5/267 |
| 3,653,081 | 4/1972 | Davis | 5/262 |
| 3,657,749 | 4/1972 | Norman | 5/271 |
| 3,657,914 | 4/1972 | Hart | 140/105 |
| 3,716,874 | 2/1973 | Thomas | 5/256 |
| 3,779,058 | 12/1973 | Norman | 72/66 |
| 3,911,511 | 10/1975 | Higgins et al. | 5/255 |
| 3,995,336 | 12/1976 | Vanderheyden | 5/256 |
| 4,053,956 | 10/1977 | Higgins | 5/255 |
| 4,095,297 | 6/1978 | Thomas, Jr. | 5/256 |
| 4,112,726 | 9/1978 | Adams et al. | 72/137 |
| 4,358,097 | 11/1982 | Zapletal et al. | 5/271 |
| 4,441,245 | 4/1984 | Thornton | 29/564 |
| 4,488,712 | 12/1984 | Higgins | 5/248 |
| 4,492,298 | 1/1985 | Zapletal et al. | 198/409 |
| 4,548,241 | 10/1985 | Zapletal et al. | 140/3 CA |
| 4,548,390 | 10/1985 | Sasaki | 5/246 |
| 4,553,324 | 11/1985 | Zapletal et al. | 29/822 |
| 4,553,572 | 11/1985 | Zapletal et al. | 140/3 CA |
| 4,593,726 | 6/1986 | Zapletal et al. | 140/3 CA |
| 4,593,809 | 6/1986 | Zapletal et al. | 140/92.8 |
| 4,625,349 | 12/1986 | Higgins | 5/248 |
| 4,639,957 | 2/1987 | Wells et al. | 5/248 |

*Primary Examiner*—P. W. Echols

*Attorney, Agent, or Firm*—Wood, Herron & Evans

[57] ABSTRACT

A single continuous length of wire is formed into a continuous length spiral or helix, which is subsequently placed onto a moving chain conveyor having pins upstanding therefrom. The helix then is folded into a wave configuration for establishing a row of parallel coils by folding the links so as to move further apart a pair of adjacent pins of adjacent links while simultaneously moving closer together other pins on the same adjacent links. Thereby, the individual spring coils are arranged in generally parallel alignment one with the other within the row. Each coil in the row is thereby connected at its opposite ends to adjacent coils by three-dimensional looped connector segments. The looped connector segments are then formed into substantially two-dimensional planar configuration by engagement of the center section of the connector segment with a forming tool, which forming tool is then operative to pull the center portion of the connector segment outwardly, and then after clamping of the end loops or turns of the coils at opposite ends of the connector segment, rotating the forming tool and the center portion of the connector segment so as to establish a connector segment having parallel opposite end sections interconnected by an offset section. During forming of the end segments or heads of the connector segment of the coils, each connectors segment is deformed from a looped three-dimensional attitude into a generally planar configuration comprising parallel end sections interconnected by an offsetting center section.

31 Claims, 28 Drawing Figures

FIG 6 FIG 6

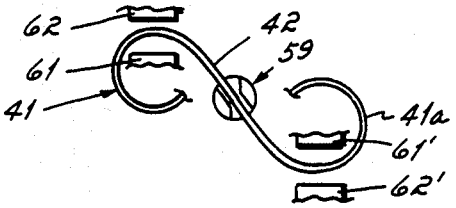

a-FORMING HEADS MOVE INTO PLANE OF END COIL CONNECTORS b-CENTER BAR MOVES OVER CENTER SECTION OF CONNECTOR

FIG. 3A

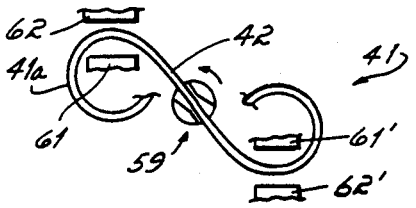

CENTER BAR ROTATES CCW TO LOCK CENTER SECTION OF CONNECTOR IN SLOT OF CENTER BAR

FIG. 3B

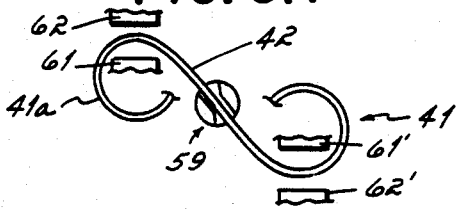

CENTER BAR RETRACTS TO PULL CENTER SECTION INTO FORMING POSITION ON FORMING HEADS

FIG. 3C

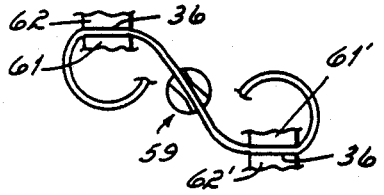

JAWS OF FORMING HEADS CLOSE TO FORM FLATS ON ENDS OF END COIL CONNECTORS

FIG. 3D

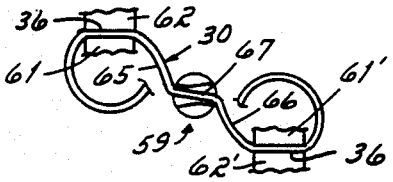

CENTER BAR ROTATES CCW TO FORM OFFSET IN STRAIGHT CENTER SECTION OF CONNECTOR

FIG. 3E

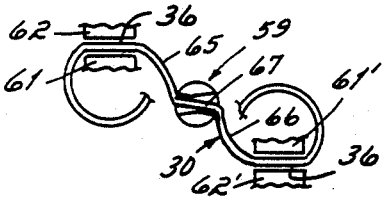

a-JAWS OF FORMING HEADS OPEN SLIGHTLY TO RELIEVE PRESSURE FROM END COIL CONNECTORS b-CENTER BAR MOVES FORWARD TO FLATTEN END PLANE OF CONNECTOR

FIG. 3F

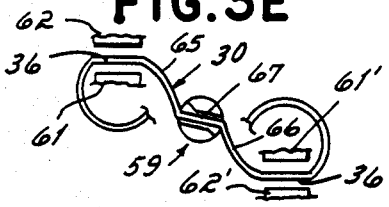

a-CENTER BAR ROTATES CW TO UNLOCK CENTER SECTION FROM SLOT IN CENTER BAR b-JAWS OF FORMING HEADS OPEN COMPLETELY TO RELEASE CONNECTOR

FIG. 3G

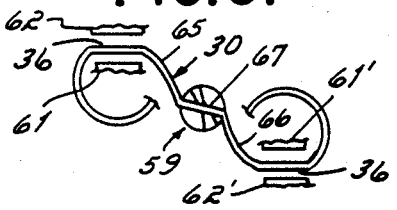

a-CENTER BAR RETRACTS AND ROTATES TO INITIAL POSITION b-FORMING HEADS RETRACT FROM PLANE OF END COIL CONNECTORS

FIG. 3H

METHOD AND APPARATUS FOR FORMING A ROW OF SPRING COILS FROM A CONTINUOUS LENGTH OF WIRE

This invention relates to coil springs. More particularly, this invention relates to a method and apparatus for forming a row of interconnected coil springs from a continuous length of wire and to the resulting product.

There are many different spring assemblies known to the prior art. One basic use of spring assemblies is in the bedding industry where those spring assemblies find use in mattresses and box springs. Another basic use is in seating assemblies and seating cushions. While spring assemblies known to the prior art are of various configurations, most such assemblies have in the past employed a plurality of rows of coil springs interconnected in the top and bottom planes of an assembly defined by those coils. The interconnection between the coils has often been wire hooks or helical wire lacings or a welded wire grid. In such assemblies, it has most often been the practice in the prior art that the spring coils within each coil row were initially separate one from the other such that the separate coil springs within each row had to be interconnected. Additionally, the adjacent rows of coil springs were required to be interconnected in order to fabricate a final spring assembly.

Prior art spring assemblies made from individual coils are generally subject to one shortcoming or another. One common problem associated with such multiple individual spring assemblies was in the quantity of wire employed to make up each individual spring coil. Another problem was that of interconnecting the individual spring coils into rows of coils and those rows into a plurality of interconnected coil rows. Both of these problems result in increased manufacturing costs to the spring assembly fabricator.

One relatively recent solution to the problems associated with prior art spring assemblies as identified hereinabove is to provide a plurality of rows of spring coils in which each coil row is formed from a single continuous length of spring wire. In other words, and although multiple coil rows are required to make the spring assembly's coil sring matrix, each row of coils is fabricated from a single continuous length of wire. In this coil row structure, adjacent coils are connected by a connector segment disposed alternately in the top plane or the bottom plane of the spring row. This type of coil row structure, i.e., the type where each row of coils is formed from a single continuous length of spring wire, is known to the prior art as a solution to the problems identified hereinabove. Typical of such coil row structures are those described in Higgins, et al. U.S. Pat. No. 3,911,511; Norman U.S. Pat. No. 3,657,749; and Norman U.S. Pat. No. 3,355,747. Other patents which disclose similar coil row structures are U.S. Pat. No. 4,053,956; U.S. Pat. No. 4,358,097; and U.S. Pat. No. 4,488,712.

One of the primary advantages of a coil row structure in which the row of coils is formed from a single continuous length of wire is that the coil row structure is capable of being formed by machine without manual assistance. One patent which discloses a machine for forming a row of coils is Adams, et al. U.S. Pat. No. 4,112,726. The machine described in that patent has been a very great success and is widely used for producing rows of coils in which adjacent rows of the coils are alternately connected in the top and bottom planes of the coils by connector segments. The machine described in that patent, though, is subject to several limitations. One of those limitations is that it is not practical for forming heavy gauge wire into rows of interconnected coils. Such heavy gauge wire is commonly utilized in box springs or mattress bedding foundations. Another limitation of the machine described in the above-identified patent is that it is incapable of forming short coils, i.e., those which employ two or three turns or revolutions in the coil, rather than four or five as illustrated and described in U.S. Pat. No. 4,112,726.

It has therefore been a primary objective of this invention to provide a new and improved method and apparatus for forming a row of coil springs from a continuous length of wire, which improved method and apparatus is capable of forming a row of coil springs from heavier gauge wire than is practical or possible with prior art machines.

Still another objective of this invention has been to provide an improved method and apparatus for forming a row of coil springs from a continuous length of wire which is capable of forming a greater variety of coil spring configurations than is possible with prior art apparatus and methods.

In accordance with these objectives, the novel method and apparatus of this invention is operative to create a row of interconnected coil springs in which adjacent coils are interconnected alternately at the top and bottom to adjacent coils by forming the continuous length of wire into a continuous helix having a longitudinal axis, thereafter positioning the continuous length of helix onto a plurality of substantially linearly aligned pins which extend generally normal to the axis of the helix and then folding the continuous length helix into a wave-like configuration by moving selected adjacent pairs of pins further apart while simultaneously moving the pins adjacent the selected pair closer together so as to create a plurality of substantially parallel spring coils in a coil row such that each of the coils is connected at one end by a connector segment with an adjacent coil to one side thereof and by another connector segment at the other end with an adjacent coil to the other side thereof. After folding of the length of continuous helix, the connector segments are located in a three-dimensional looped attitude. The connector segments of the folded helix are then formed into a desired substantially flat configuration. The forming operation is carried out by pinching the coils at the ends of each connector segment between pairs of dies and then grasping the center portion of each connector segment and rotating it while the coils at the opposite ends of the connector segment remain pinched between the dies. This results in forming of an offset center portion of the connector segment located between substantially parallel but offset opposite end portions of the conenctor segment. In the preferred practice of the invention, the pairs of dies which pinch the endmost loops of adjacent coils at opposite ends of each of the connector segments are operative to form cordal flats in the end loops of the coils, which cordal flats are then connected to opposite ends of the connector segments.

One aspect of the invention of this application is predicted upon the concept of folding a helically wound wire into sinusoidal wave form by positioning the helically formed wire onto a conveyor of upstanding pins and then repositioning the pins of the conveyor so as to effect folding of the helically formed wire into a generally square wave configuration of parallel interconnected coils.

Another aspect of this invention is predicted upon the method of forming three-dimensional looped connector segments of adjacent coils into a flat two-dimensional connector segment by clamping the endmost coils at opposite ends of the connector segment between clamping dies and then, while those loops remain clamped between the dies, engaging the center portion of the connector segment with a forming tool and rotating the forming tool and center portion of the connector segment so as to form the connector segment into a pair of parallel end portions interconnected by an offset portion.

Another aspect of this invention is predicted upon the unique and novel configuration of the rows of interconnected coil springs created by the practice of this method and apparatus. This configuration and this method of forming and shaping the rows of interconnected coils according to the practice of this invention enables this invention to create new and improved products, including new and improved box springs.

Other objects and advantages of this invention will be more readily apparent from the following detailed description of the drawings in which:

FIGS. 3A through 3H are sequential views of the steps through which a connector segment of interconnected coils is passed in the course of being formed in the configuration illustrated in FIGS. 1 and 2.

BOX SPRING MADE IN ACCORDANCE WITH COIL ROW FORMING METHOD AND APPARATUS

Figure 1:
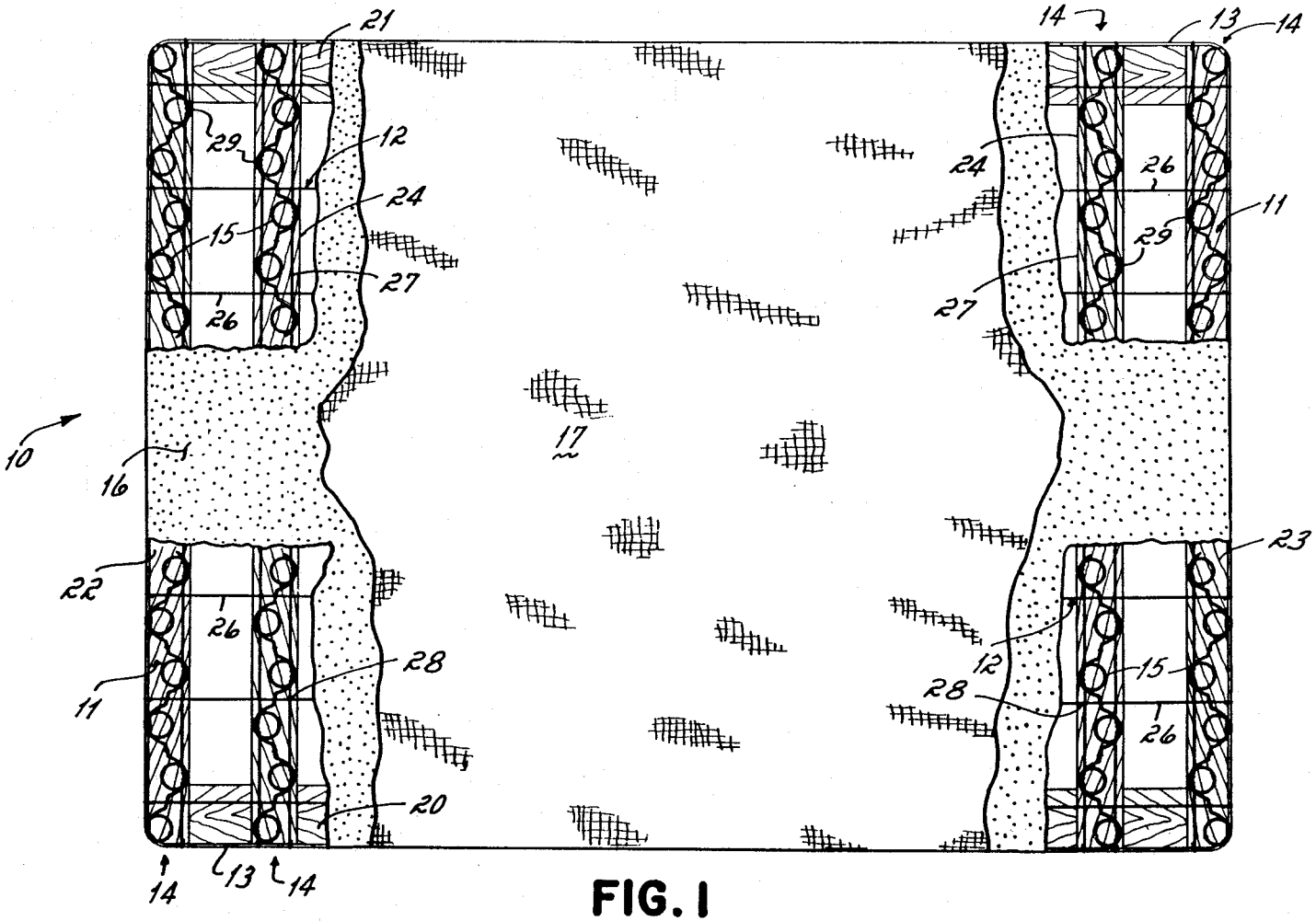
FIG. 1 is a top plan view, partially broken away, of a box spring made in accordance with the practice of the invention of this application.
Figure 2:
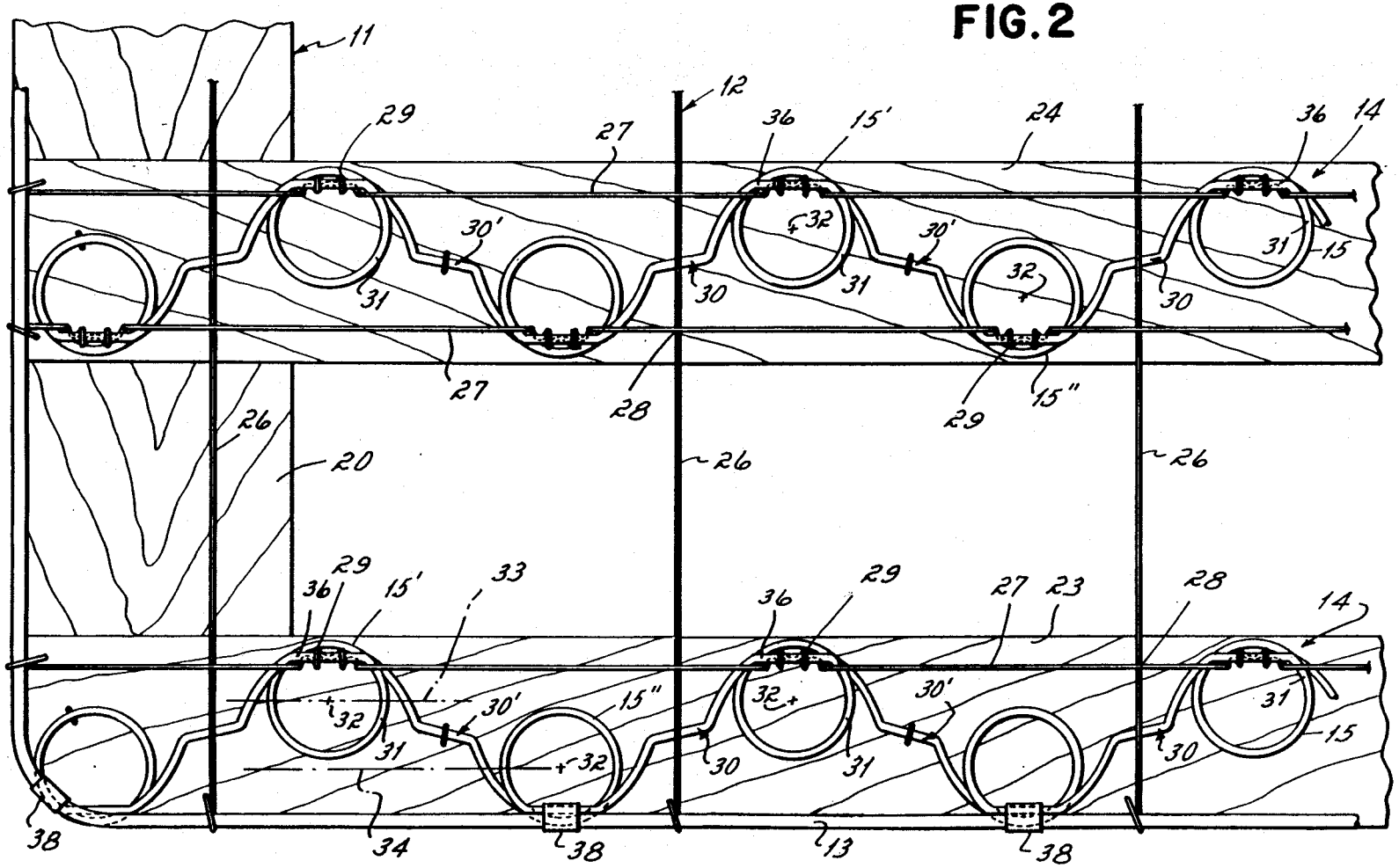
FIG. 2 is an enlarged top plan view of one corner of the box spring of FIG. 1.

A box spring incorporating the novel rows of interconnected coil springs manufactured in accordance with the invention of this application is illustrated in FIGS. 1 and 2. This box spring 10 comprises a wooden base frame 11, a welded wire grid 12 including a border wire 13, and a plurality of rows 14 of interconnected coils 15. Each row of coils is formed from a single continuous length of wire. The top of the wire grid is covered with a pad 16 and the complete assembly encased within an upholstery covering 17. The upholstery covering encases and encloses the complete box spring, including the base frame 11, the rows 14 of coil springs 15, the wire grid 12, and the padding 16.

The base frame 11 is conventional and characteristic of many box springs. It comprises a pair of side boards 20, 21 interconnected by a pair of end boards 22, 23. The end boards are nailed, stapled or otherwise fixedly secured to the tops of the ends of the side boards. Additionally, there are spaced slats 24 nailed or other wise fixedly secured to the top of the side boards and extending parallel to the end boards.

The welded wire grid 12, padding 16 and upholstery covering 17 are also conventional. The wire grid comprises the border wire 13 between opposite ends of which there extend parallel spaced longitudinal wires 26. The ends of the longitudinal wires 26 wrap around the border wire 13 and are preferably welded thereto. The wire grid 12 also includes a plurality of parallel transverse wires 27 which extend between opposite sides of the border wire 13. The ends of these transverse wires 27 also wrap around the border wire and are preferably welded thereto. Additionally, the intersections 28 of the transverse wires 27 and the longitudinal wires 26 are also preferably welded.

There are U-shaped hooks 29 formed in the transverse wires 27 of the wire grid 12. These U-shaped hooks open downwardly so that the topmost coils or loops 31 in a row of coil springs 14 may be inserted therein. The hooks are crimped shut about the top loops of the coils so as to secure the topmost loops of the coils to the wire grid. A wire grid having hooks 29 formed therein similar to the hooks utilized in this application is completely disclosed in U.S. Pat. No. 3,577,574. Accordingly, the wire grid, and particularly the hooks formed in the wire grid, have not been illustrated and described in detail in this application. The disclosure of U.S. Pat. No. 3,577,574 is hereby incorporated by reference for purposes of completing the disclosure of the wire grid and particularly, the details of the hooks 29 and the method by which those hooks are formed in the grid.

The novelty of the box spring 10 resides in the rows 14 of interconnected coil springs 15. Each of these rows of coil springs comprises a plurality of parallel coil springs 15, the opposite ends of which are connected to adjacent coils by connector segments 30, 30'. In the illustrated embodiment, the topmost turns or loops 31 of each coil is connected to one adjacent coil by a connector segment 30, and the bottom loop or turn is connected to another adjacent coil of the same row by a connector segment 30'. In the preferred embodiment, alternate ones 15' of the coil springs 15 have their axes 32 located in a common plane 33 while the coils 15'' located between the alternate coils have their axes 32 located in a second parallel plane 34 spaced from the plane 33. Thus, each coil is staggered relative to the adjacent coils of the same row. Additionally, it is to be noted that alternate coils of each row are connected to a common transverse wire 27 of the welded wire grid 12. Thereby, noise or clashing between the coils and the wires of the grid is avoided.

It is also to be noted that the endmost turn or loop 31 of each coil has a flat 36 formed thereon. The flat 36 of the topmost turn is connected by the connector segment 30 to the flat of an adjacent coilo, while the flat 36 of the bottom turn or loop is connected to one end of the connector segment 30' of another adjacent coil. It is these flats which fit into and are received within the hooks 29 of the wire grid so as to connect the top most turn of each coil to a transverse wire 27 of the wire grid.

In the illustrated embodiment, the connector segments 30', which interconnect the bottom turns of the coils to adjacent coils, are attached to end board 22, 23 or transverse slat 24 of the wooden frame. The endmost rows of coils, which are mounted atop the end boards 22, 23 of the base frame, are secured to the border wire 13 by conventional sheet metal clips 38.

In the manufacture of the box spring illustrated in FIG. 1, the base frame 11 is conventionally preassembled. The rows 14 of coil springs 15 are then secured atop the base frame by stapling the connector segments 30' between the bottom turns of adjacent coils to the tops of the end boards 22, 23 and transverse slats 24. Additionally, the endmost coils in a row of coils are stapled to the top of the end boards and transverse slats. The preassembled wire grid 12 is then mounted atop the assembled wooden frame and coil springs. When the wire grid is placed atop the top turns of the coil springs 15, the open ends of the generally U-shaped hooks 29 formed in the transverse wires of the grid are fitted over the flats 36 formed in the top turn of each coil. The hooks 29 are then crimped shut so as to thereby fixedly secure the wire grid to the top turns of the coils. The border wire is then connected by the sheet metal clips 38 to the top turns of alternate ones of the coil springs in the endmost row of coil springs. Thereafter, the box spring is completed by placement of the padding 16 over the top of the wire grid and then securement of the upholstered covering 17 over and around the complete assembly of base frame, rows of coil springs, wire grid, and padding.

Prior to this invention, it has not been possible to manufacture box springs from rows of coil springs in which each coil row is formed from a single continuous length of spring wire because there has never existed, prior to this invention, any method or apparatus for forming the relatively heavy gauge box spring wire into such a row of coil springs. In general, box spring assemblies utilize No. 8 or 9 gauge spring wire, while mattresses utilize No. 13 or 14 gauge wire. The machinery and forming method disclosed in U.S. Pat. No. 4,112,726 is operable to form the relatively light gauge mattress spring wires into rows of interconencted coils springs, but that same apparatus is not suitable for forming the relatively much heavier gauge box spring wire into similarly configurated rows of interconnected coil springs. The method and apparatus described hereinbelow enables for the first time the rows of coil springs to be formed from a continuous length of heavy gauge, such as No. 8 or No. 9 gauge, spring wire wherein each coil of the row is connected at one end to an adjacent coil of the row.

Coil Row Forming Method

Figure 3:
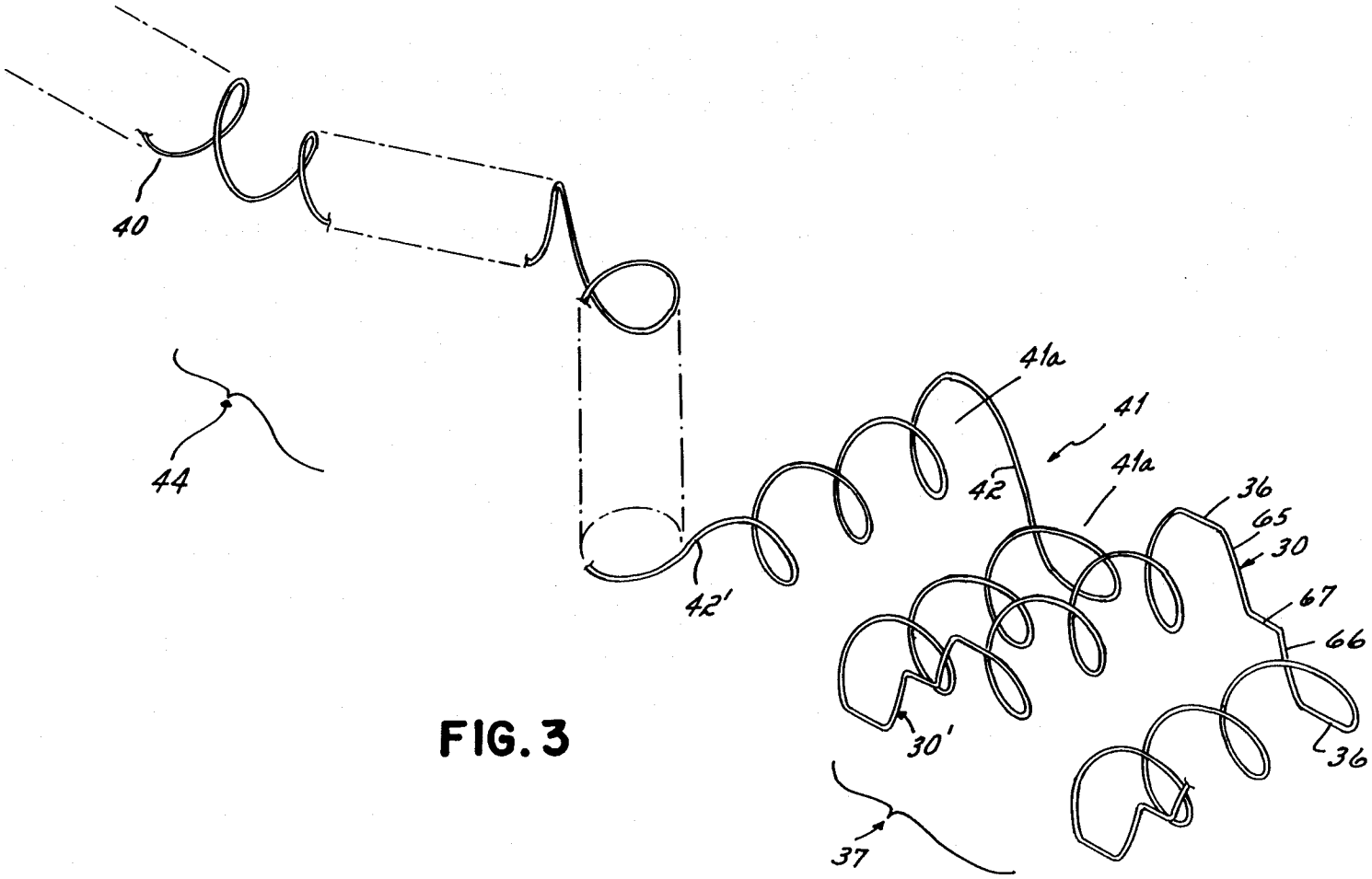
FIG. 3 is a perspective view of the forming steps through which a row of springs is passed in the course of being formed into a row of interconnected coil springs made in accordance with the invention of this application.

With reference to FIGS. 3, **3*a*–3*h*, and 4, there is illustrated the method for forming the row of coil springs illustrated in FIGS. 1 and 2**.

The first step in forming the row of coils is that of shaping a single continuous length of wire 39 into a continuous length of helical configuration 40. The helix is circular and has the same diameter and pitch characteristics throughout its length. The continuous length helix 40, a section of which is illustrated in FIG. 3, then functions as the input or infeed to subsequent shaping operations. While the linear continuous length helix 40 may be formed by any known method or apparatus, as for example that disclosed in Norman U.S. Pat. No. 3,541,828 or Norman U.S. Pat. No. 3,779,058, it is preferably formed by the forming method and apparatus disclosed in pending applciation Ser. No. 850,846 filed Apr. 11, 1986 and assigned to the assignee of this application.

Figure 4:
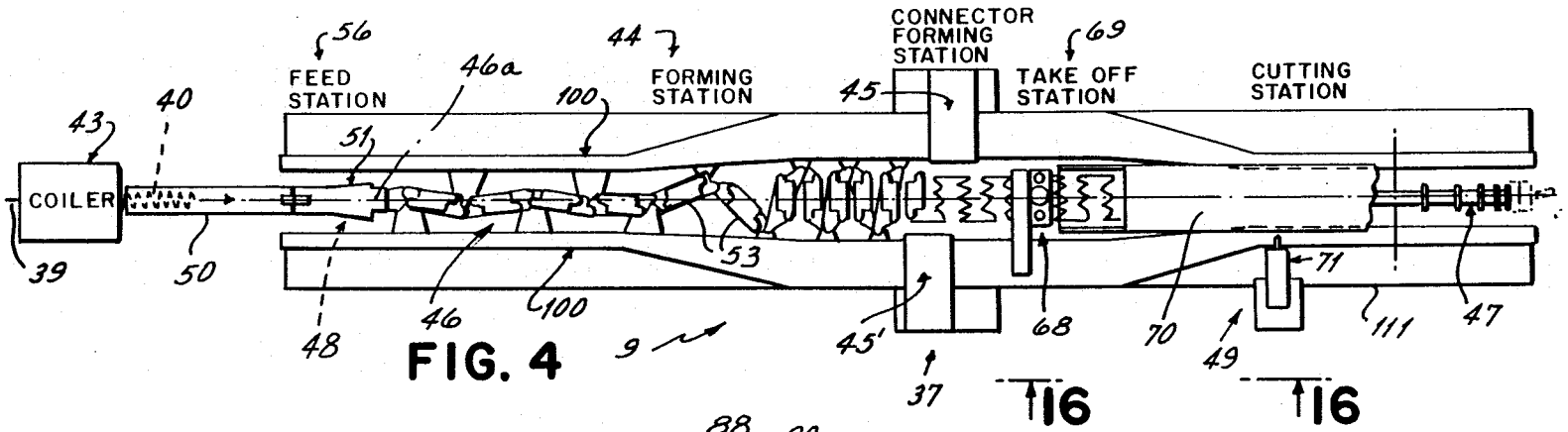
FIG. 4 is a partially diagrammatic top plan view of the apparatus for manufacturing a row of interconnected coil springs in accordance with the practice of the invention of this application.

After the continuous length helix 40 has been formed by the coiler 43, it is then folded into a generally square wave configuration 41 in the course of passage through a folding station 44 (FIG. 4). The folding station forms the continuous length helix section 40 into a plurality of parallel coils **41*a* with looped, three-dimensional connector sections 42, 42' therebetween. In other words, the folding station 44 transposes the linear helix 40 into a folded helix 41 having multiple coils 41*a* interconnected by connector segments 42, 42', but the connector segments 42, 42' are in a three-dimensional looped, generally concave attitude at this stage. The square wave configuration is attained by folding the continuous length helix 40** back upon itself in accordion-like fashion at spaced intervals so as to define the final continuous row of coils.

The folding step in forming the final continuous coil row determines the number of helical loops or turns within each coil of the finished coil row. As illustrated herein, each finished coil spring 15 within the coil spring row 14 is provided with 3½ helical loops or turns. However, a greater or lesser number of loops or turns may be formed in accordance with the invention of this application.

After the continuous length helix 40 has been folded from the linear input attitude into the folded square wave attitude 41, the connector segments 42, 42' between adjacent coils **41*a* of the coil row are then formed at a forming station 37 into the more lanar, generally S-shaped configuration from the three-dimensional looped attitude generated in the folding step. The forming of the looped three-dimensional connector segments into the more planar, generally S-shaped connector segments 30, 30', is illustrated in FIGS. 3A–3H. In this forming sequence, an upper and a lower connector segment 30, 30', respectively, are formed simultaneously by a pair of forming heads 45, 45' located on opposite sides of a conveyor line 46 upon which the continuous helix 40 and then the folded helix 41 is transported through the folding and forming operations. After passage through the connector forming station 39, the connected coils pass off of the conveyor 46 while the conveyor then passes over a forward drive sprocket 47 and is returned to the rear feed sprocket 48 of the conveyor. The connected coils then pass through a cutting station 49** wherein the ends of the row of coils are cut from the adjacent coils.

Figure 6:
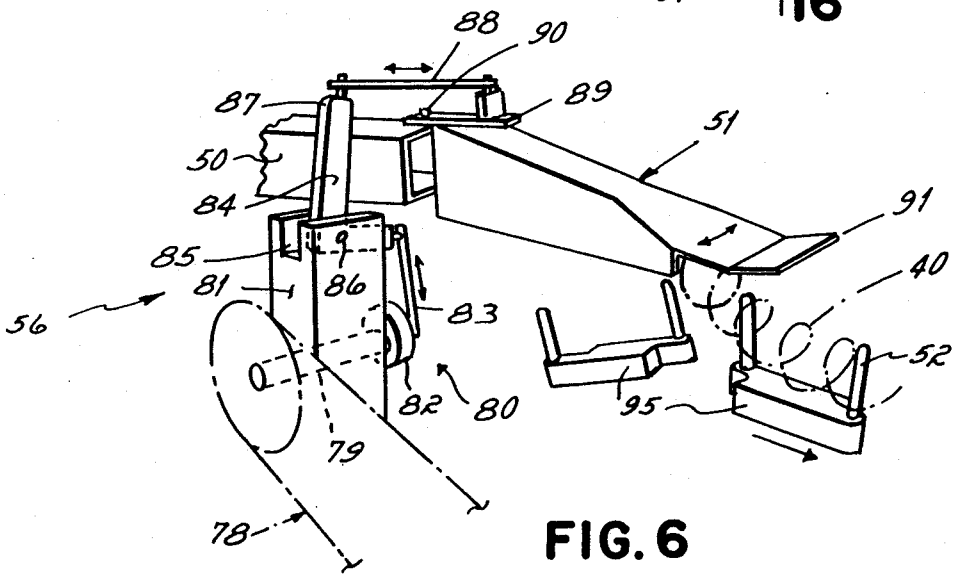
FIG. 6 is a perspective view of a portion of the feeding station of FIG. 4.
Figure 7:
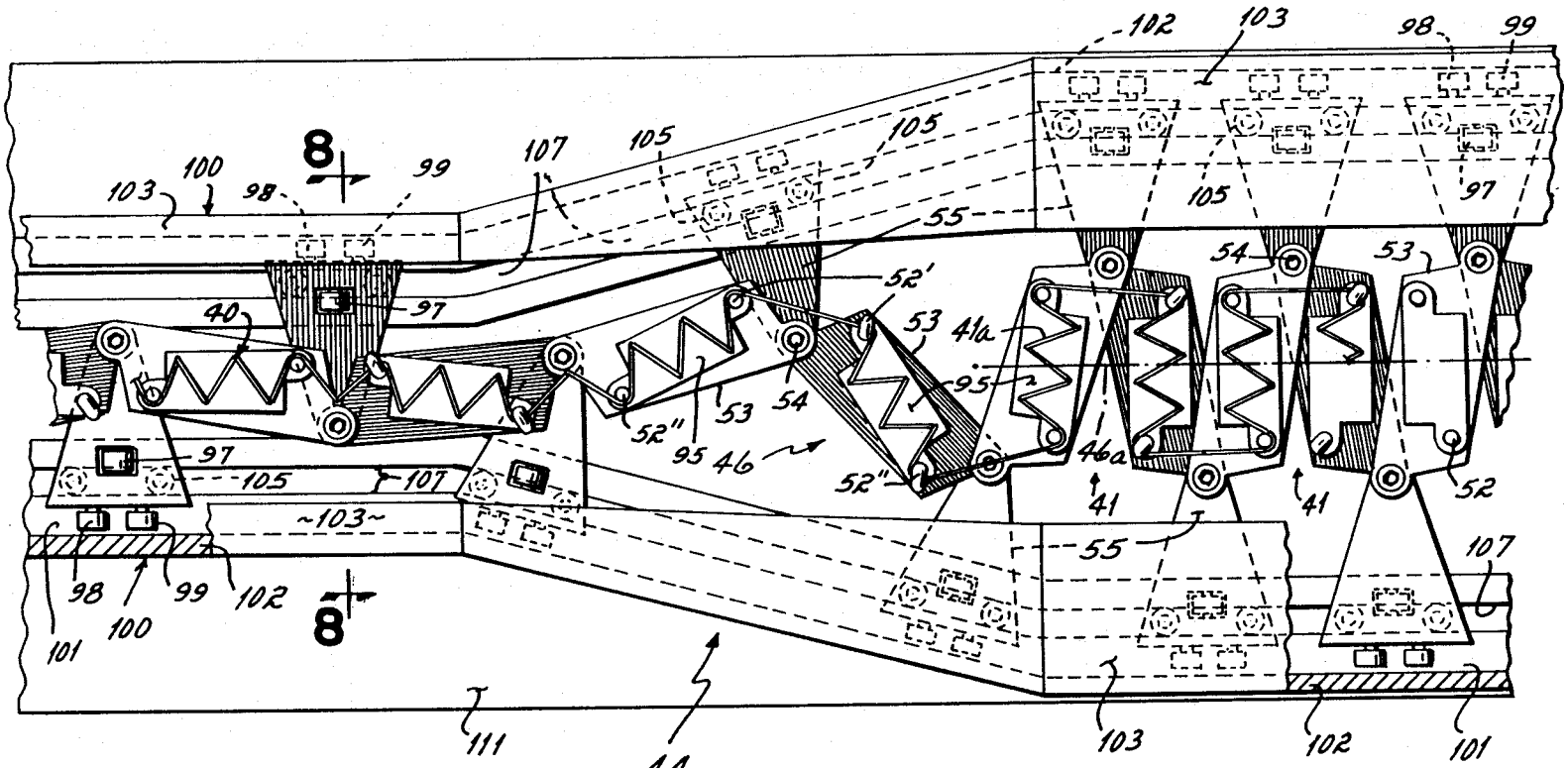
FIG. 7 is an enlarged top plan view of the folding station of the machine of FIG. 4.

In order to effect folding of the linear helix 40, the helically formed wire from the coiler 43 is fed into and through a chute 50 of feed station 56 (FIGS. 4, 5 and 6) and through an oscillating feed trough 52 onto upstanding pins 52 of the conveyor 46. These pins 52 are upstanding from a plurality of generally linearly aligned links 53 of the conveyor 46 when the helically wound wire is positioned onto the pins. Thereafter and as the helically wound wire is transported on the conveyor 46, the pin supporting links 53 are caused to be pivoted into parallel alignment so as to move selected adjacent pairs of pins 52' on adjacent links further apart while simultaneously moving other pins 52" on the same adjacent links, but spaced outwardly from the selected pairs of pins, toward one another. Thereby, the square wave configuration of the helically formed wire is created. This pin movement is best illustrated in FIG. 7 where it may be seen that the links 53 are pivotally interconnected by pivot posts 54. These pivot posts are in turn connected to cam follower plates 55 operative to cause the pivot posts and the attached conveyor links 53 to be moved out of linear alignment into substantially parallel alignment In the course of the movement from the generally linear alignment to the parallel alignment, the pins 52 mounted upon the links 53 are caused to move with the links. In the course of this movement, selected pairs of adjacent pins 52' on adjacent links 53 are caused to move further apart, while the remote pairs of pins 52" of the adjacent links 53 are caused to move closer together, thereby causing the generally linear helix to be moved into the square wave configuration 41.

After placement of the helical wire into the square wave configuration, each coil **41*a* is connected to an adjacent coil 41*a* by a connector segment 42 at one end and to another adjacent coil by another connector segment 42' at the opposite end. At this time, each connector segment 42, 42' is shaped as a three-dimensional, generally concave loop, which in order to form the completed rows of coils must be moved into a planar configuration without causing the axes of the adjacent coils to be moved out of parallelism. In order to so shape and configure the connector segment 42, each connector segment is shaped by the connector forming heads 45, 45' at the connector forming station 37. Two heads on opposite sides of the conveyor 46 move simultaneously into engagement with the connector segments on opposite ends of one coil, and simultaneously shape those connector segments. With reference to FIGS. 3A–3H, there if illustrated diagrammatically the sequence of operations performed at one forming station 45** in order to complete the formation of the connector segments.

With reference to FIG. 3A, it will be seen that the first step in the forming of the three-dimensional, generally looped connector segment 42 into the planar offset connector segment 30 is to move the complete forming heads 45, 45' (FIG. 4) inwardly so as to locate a pair of clamping dies 61, 62 over a portion of the endmost loop of a pair of adjacent coils. Simultaneously, a generally V-shaped channel 60 of a center bar forming tool 59 is moved over the center section of the connector segment 42.

With reference to 3B, it will be seen that the next step in the formation of the connector segment 42 to the generally planar connector segment 30 is to grasp the center section of the connector segment 42. This is accomplished by rotating the center bar 59 through an angle of approximately 15° so as to position a groove or slot 58 at the bottom of the V-shaped groove 60 over the center section of the connector segment 42. Thereby, the center section of the connector segment is entrapped within the groove 58.

As depicted in FIG. 3C, the center bar forming tool 59 with the center portion of the connector segment 42 entrapped in the groove 58 of the center bar, is then retracted outwardly away from the center line **46*a* of the conveyor 46 so as to pull the center portion of the connector segment into the forming heads 45** and into a more planar configuration.

As depicted in FIG. 3D, the jaws 62 of the forming heads are then caused to move inwardly into engagement with the stationary die 61 of each pair of clamping dies. This has the effect of forming a flat 36 on the endmost loop or turn of the coil springs on opposite sides of the connector segment 42. This also has the effect of clamping the endmost coils between the dies 61, 62 so that the connector segment 42 may thereafter be shaped so as to take up slack between the clamped endmost turns of adjacent coil springs.

With reference to FIG. 3E, it will be seen that the next step in the sequence of forming the connector segment 30 between adjacent coils of the row of coils is to further rotate the center bar forming tool 59 while the center portion or section of the connector segment is entrapped in the groove 58 in the bottom of the V-shaped groove 60 of the center bar. The center bar is then rotated through an additional approximate 30° in the same direction (counterclockwise as depicted in FIGS. 3A–3F) so as to take up all slack in the connector segment 42 and move the wire beyond its modulus of elasticity so as to create the connector segment 30 having generally parallel opposite end sections 65, 66 interconnected by a straight offset center section 67.

With reference to FIG. 3F, the shaping of the connector segment 30 is then completed by slight outward movement of the forming jaws 62 so as to relieve the pressure from the connector segments, after which the center bar 59 is moved slightly inwardly or toward the center line **46*a* of the conveyor so as to generate a more planar configuration of the connector segment 30**.

With reference to FIGS. 3G and 3H, it will be seen that with the connector segment 30 completely formed, the forming head is disengaged from the connector segment by rotation of the center bar through an angle fo approximately 15° in a clockwise direction so as to align the bottom of the V-shaped groove 60 with the offset center section 67 of the connector segment. Simultaneously, the dies 62 of the clamping dies are moved outwardly to completely release the connector segment. Thereafter, the forming head 45, 45' are moved outwardly away from the center line **46*a* of the conveyor 46 so as to move the center bar and clamping dies out of vertical alignment with the connector segment. The conveyor 46 may then be indexed forwardly so as to align the next pair of unformed connector segments 42 with the connector forming heads 45, 45'**.

This procedure of sequentially forming pairs of connector segments on opposite ends of each coil is repeated as the row of coils is indexed past the connector forming heads 45, 45'. As the completely formed coils and connector segments move away from the forming station 37, the coils are lifted by a litter mechanism 68 of the take-off station 69 from the pins 52 of the conveyor 46 and onto a discharge chute 70. As the formed coils and connector segments move through the discharge chute 70 and past the cutting station 49, a cutter 71 located at the cutting station 49 is periodically actuated to sever one row of coils from another. From example, if the row is to contain 15 connector coils, then the cutter is actuated to sever adjacent coils each time the fifteenth coil of a row passes the cutting station.

After removal of the formed coils and connector segments from the pins 52 of the links 53 of the conveyor 46, the links 53 of the conveyor are then caused to move by the cam follower plates 55 back into generally linear alignment as illustrated in FIG. 4 and then passed around the forward feed sprocket 47 for return to the upstream end of the conveyor 46.

Feeding Station

The rear sprocket 48, feed station 56. folding station 44, connector forming station 37, take-off station 69, cuttin station 49, and forward sprocket 47 of the return section of the machine or apparatus 10 for forming the rows of coils 14 are all driven from a single drive source. This drive source comprises a motor (not shown) operative to index and intermittently drive a main feed drive shaft (not shown), which in turn synchronizes the drive of all of the drive systems at each of the stations of the machine 9. Since such intermittent synchronized drives are well known, the drive has not been illustrated and described herein.

The coiler 43 is also driven from the same drive motor as the main drive shaft but on a continuous, rather than an intermittent, basis. As mentioned hereinabove, helically wound wire formed in the coiler 43 is fed through a chute or sleeve 50 and a downwardly open fed trough 51 onto the pins 52 of the conveyor 46. The feed station of the conveyor is operative to feed the helically wound wire onto the pins 52 and to transport the helically wound wire into the folding station of the machine.

The feed station 56 comprises the rear feed sprocket 48 mounted upon a drive shaft 72. This sprocket comprises a wheel 73 having drive rollers 74 mounted on the periphery thereof. These rollers 74 are rotatably mounted upon shafts 75 which are in turn supported between roller supporting plates 76. The plates are in turn secured to the outer edge of the wheel 73 by bolts 77.

Figure 5:
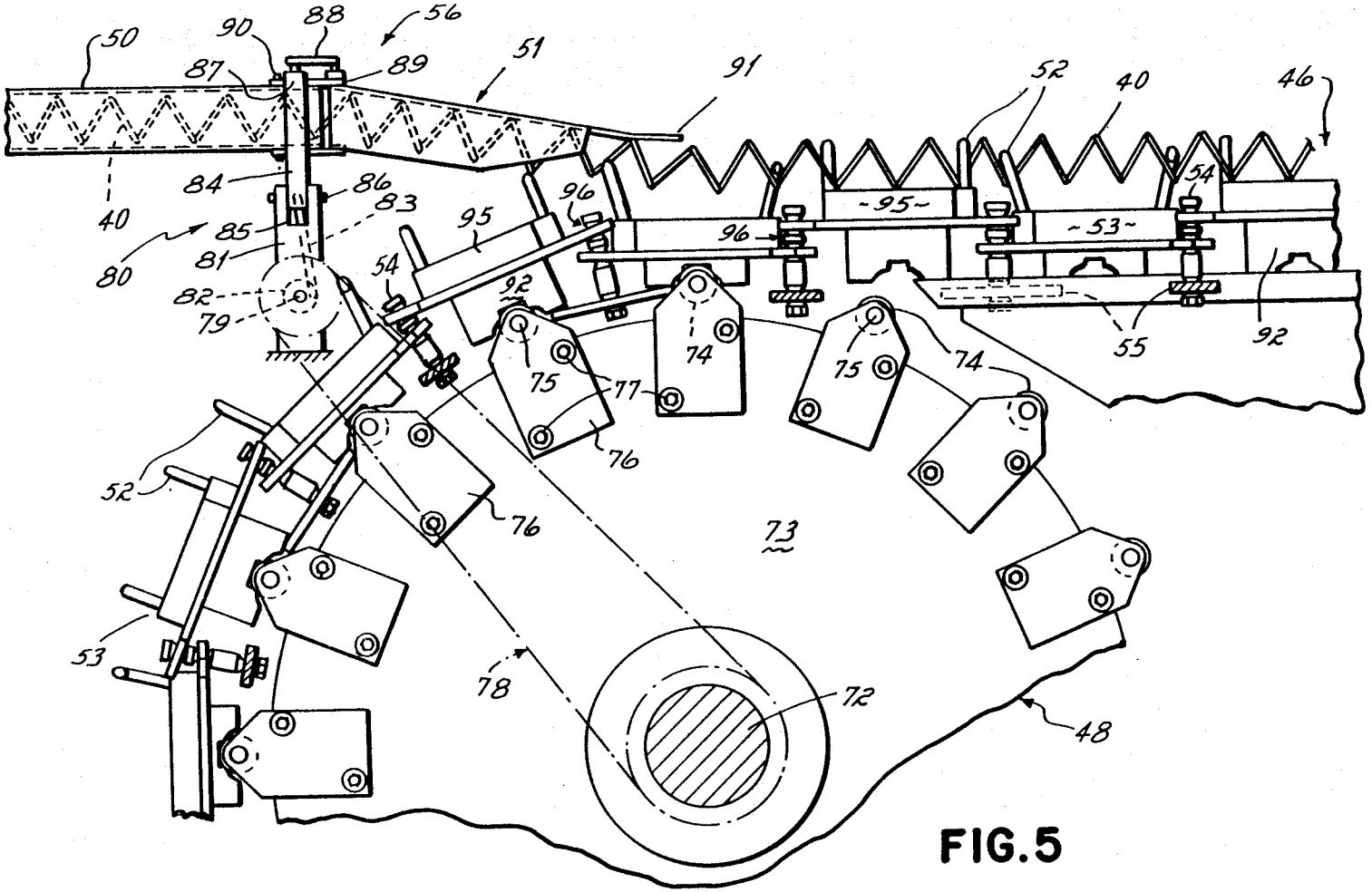
FIG. 5 is a side elevational view of the feeding station of the machine of FIG. 4.

The same intermittently driven shaft 72 which drives the rear feed sprocket 48 is also operative to effect oscillation of the feed trough 51. With particular reference to FIGS. 5 and 6, it will be seen that the drive shaft 72 is connected via a conventional chain and sprocket drive 78 to a drive shaft 79 of the trough oscillation mechanism 80. This mechanism comprises the shaft 79 mounted in a fixed support 81. On the opposite end of the shaft 79 from the driving sprocket there is a wheel 82 having a eccentrically mounted rod 83 pivotally secured thereto. This rod is operative to cause the lower end of a bell crank 84 to be moved vertically within a slot 85 of the fixed support 81. The bell crank 84 is pivotally mounted by a pin 86 within the slot 75. Vertical movement of the lower end of the bell crank 85 by the rod 83 effects oscillatory horizontal movement of the upper end 87 of the bell crank. This upper end 87 is connected by another rod 88 to a lever 89 fixedly secured to the top surface of the trough 51 and pivotably attached to the chute 50 by pin 90. As a consequence of this connection, rotary movement of the shaft 79 effects oscillatory lateral movement of the upper end 87 of the bell crank and consequently, oscillatory lateral movement of the outer end 91 of the trough 51. The trough 51 is open on its lower side and at the front end so as to permit pins 52 moving on the rear feed sprocket 48 to move through the open bottom of the trough and to pick up helically wound wire contained within the trough. The oscillatory movement of the forward end 91 of the trough is operative to locate or position the helically wound wire onto the pins 52, thereby insuring that the helically wound wire is properly positioned onto the pins with the appropriate number of turns of revolutions of the helix located between adjacent pins.

The conveyor 46 which is ridable over the rear feed sprocket 48 and the forward feed sprocket 47 comprises a chain link conveyor, the links 53 of which are supported by the pivot posts 54. On the underside of each link 53 there is a drive block 92 having a generally inverted V-shaped groove in the bottom surface thereof for reception of the drive wheels 74. On the top side of each link 53 there is a pin supporting block 95 within which the pins 52 are mounted.

The links 53 are required to pivot about the posts 54 in three dimensions, and to that end, each link 53 is connected to the post by a universal type bearing 96. This bearing 96 enables the links to pivot in a vertical plane relative to one another as the links move around the sprckets 47, 48 while still enabling the links to pivot relative to one another in a horizontal plane as the links move downstream and are operative to fold the helical wire into a generally square wave configuration as illustrated in FIG. 7.

In order to control and effect pivoting movement of the links in the horizontal plane as the links move over the upper run of the conveyor 46 between the rear feed sprocket 48 and the forward drive sprocket 47, there are cam follower plates 55 attached to each of the pivot posts 54 of the conveyor. These cam follower plates 55 are generally triangular in shape when viewed in top plan (see FIG. 7) with the apex of the triangular shaped plate pivotally attached to the bottom or inner end of each post 54. It is to be noted, as may be again most clearly seen in FIG. 7, that every other one of the cam follower plates 55 extends in the same direction from the posts 54. In other words, every cam follower plate extends outwardly to one side of the conveyor 46 on the side opposite from the adjacent cam follower plates. As explained more fully hereinafter, these cam follower plates 55 control movement of the pivot posts 54 away from the longitudinal center line 46a of the conveyor 46 so as to effect movement of the helically wound wire from the linear helix into the square wave configuration of the rows of parallel coils.

Figure 8:
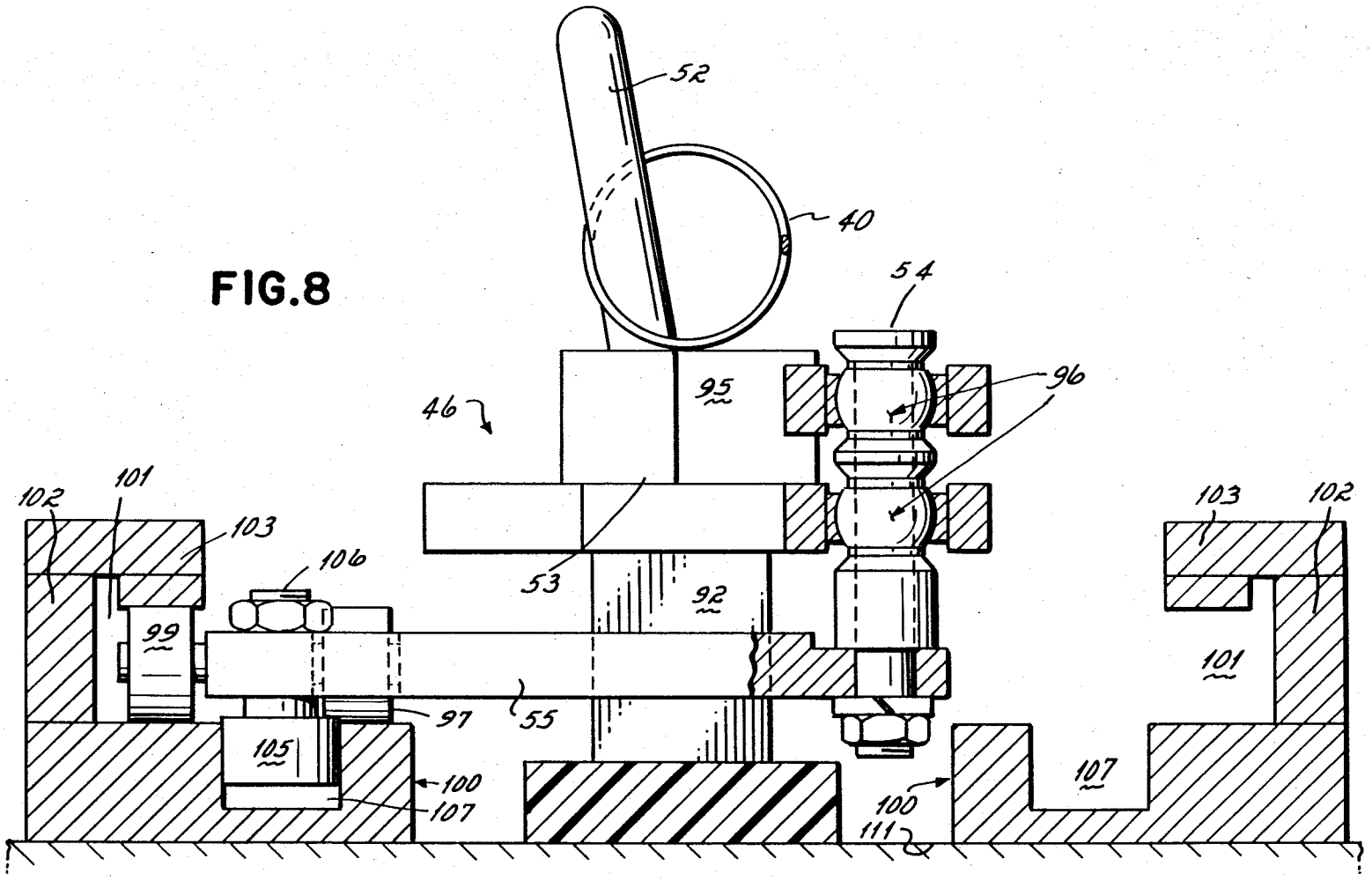
FIG. 8 is an enlarged cross-sectional view taken on line 8—8 of FIG. 7.

With reference to FIGS. 7 and 8 it will be seen that each cam follower plate 55 has three cam follower rollers 97, 98, 99 rotatable about horizontal axes and mounted for movement over a cam track 100. The outermost pair 98, 99 of these cam follower rollers are entrapped within a channel 101 defined by the cam track 100, a spacer 107, and a top rail 103. Additionally, there are a pair of cam follower rollers 105 rotatable about vertical axes and extending from the underside of the cam follower plate 55 upon supporting shafts 106. These cam follower rollers 105 travel within and follow a groove 107 in the top surface of the cam track 100.

Folding Station

With reference now particularly to FIGS. 4 and 7, it will be seen that the cam tracks 100 extend generally parallel to the longitudinal axis 46a of the conveyor 46 through the feed station of the machine, but that these tracks and the cam grooves or channels 101, 107 formed therein diverge away from the longitudinal axis 46a of the machine at the folding station. As a consequence of this divergence, the cam followers 105 following the grooves 107 cause the pivot posts 54 of the link conveyor to move outwardly or away from the longitudinal axis 46a of the conveyor as the links and the helically formed wire supported thereon pass through the folding station 44. This outward movement of the pivot posts 54 results in the links 53 being caused to move into generally parallel alignment within the folding station from the colinear alignment which had existed upstream from the folding station. When the links move into parallelism, the helix supporting pins 52' located immediately adjacent to the pivot posts 54 are caused to separate or move apart, while the pivot pins 52'' at the opposite ends of the links from the pins 52' are caused to move together or toward one another. Thereby, the helically formed wire 40 is changed from a linear configuration to a square wave configuration 41. In this square wave configuration, the individual coils are located in parallelism with the ends of the coils interconnected by the generally three-dimensional looped connector segments 42. The coils remain in this parallel orientation as the helix then is indexed through the connector forming station 37 of the machine 9.

Connector Segment Forming Station

The continuous rows of parallel coils in the square wave configuration are intermittently fed or indexed into the connector segment forming station 37 comprising the forming heads 45, 45' of the machine 9. At this station, the forming heads 45, 45' are moved inwardly so as to engage the center bar forming dies 59 of the forming heads with the center section of the connector segment 42 and simultaneously position the clamping dies 61, 62 over the endmost turns of the coils.

The forming heads are then operated so as to carry out the forming operation described hereinabove and illustrated in FIGS. 3A–3H.

The two forming heads 45, 45' are identical and therefore only one, the head 45, will be described in detail herein. It will be appreciated, though, that an identical head 45' is located on the opposite side of the conveyor 46 from the head 45.

As can best be seen with reference to FIGS. 9–14, the head 45 comprises a body 110 fixedly mounted to the frame 111 of machine 9 and above the side rail 103 of the cam track 100. Within the body, there are three parallel bores 112, 113, and 114. The two outermost ones of these bores 112, 113 house the clamping jaws actuating mechanisms, and the centermost one 113 houses the mechanism for actuating the center bar forming die 59.

Figure 10:
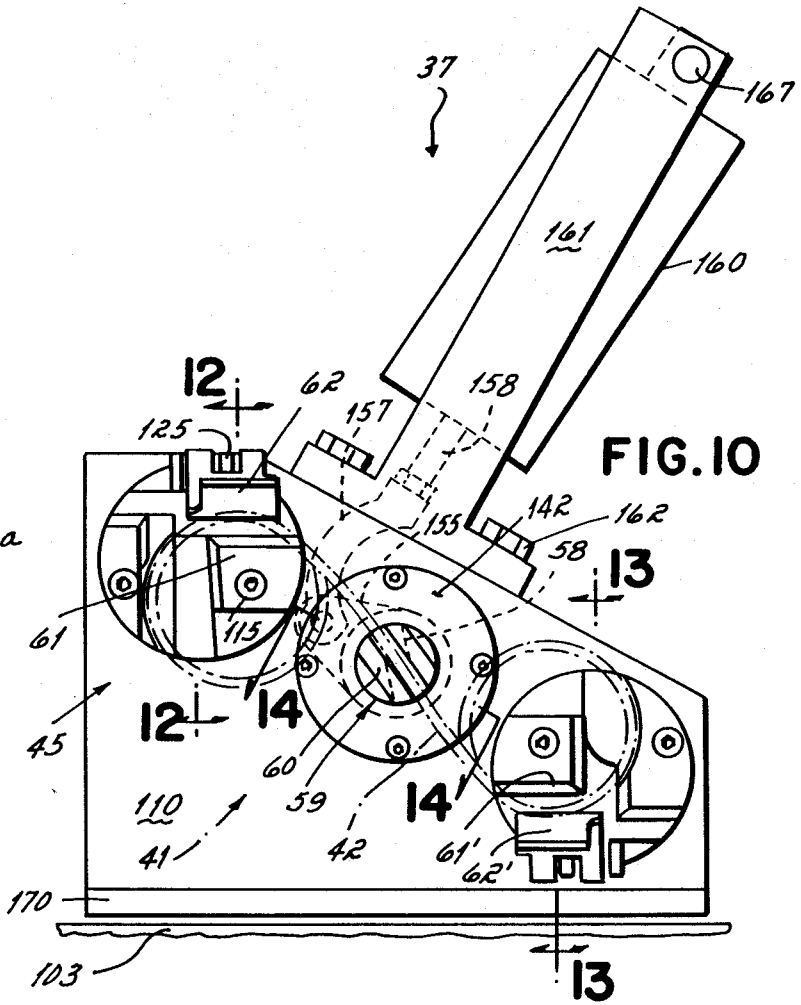
FIG. 10 is a cross-sectional view taken on line 10—10 of FIG. 9.
Figure 10A:
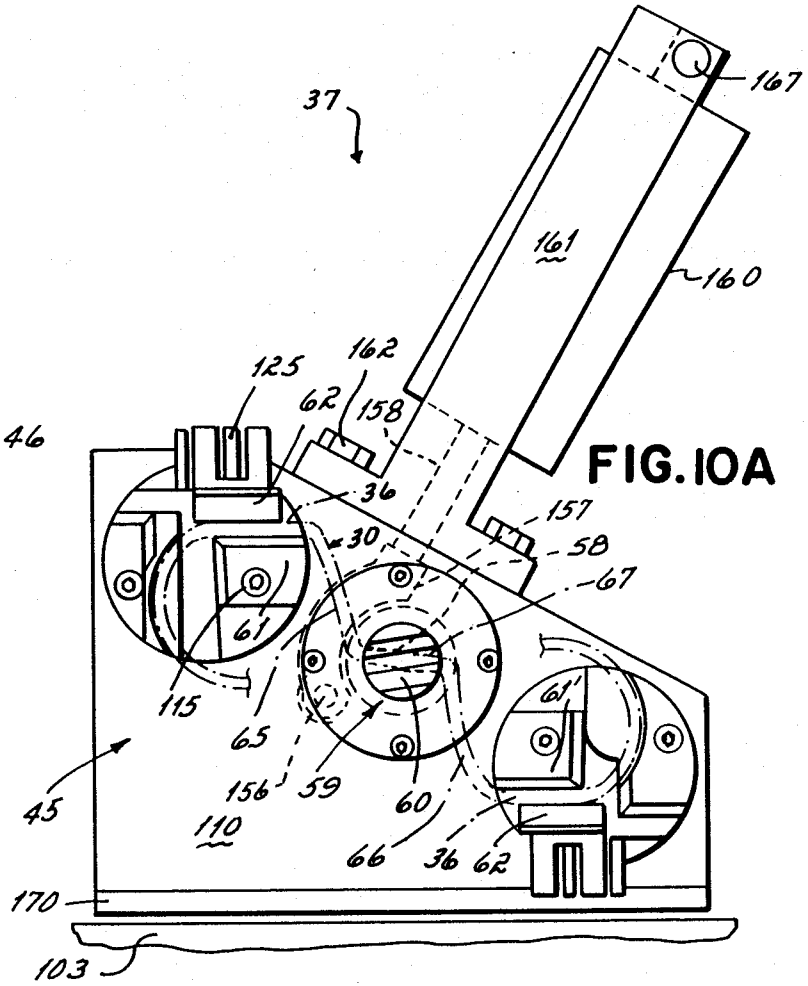
FIG. 10A is a cross-sectional view taken on line 10A—10A of FIG. 9A.
Figure 12:
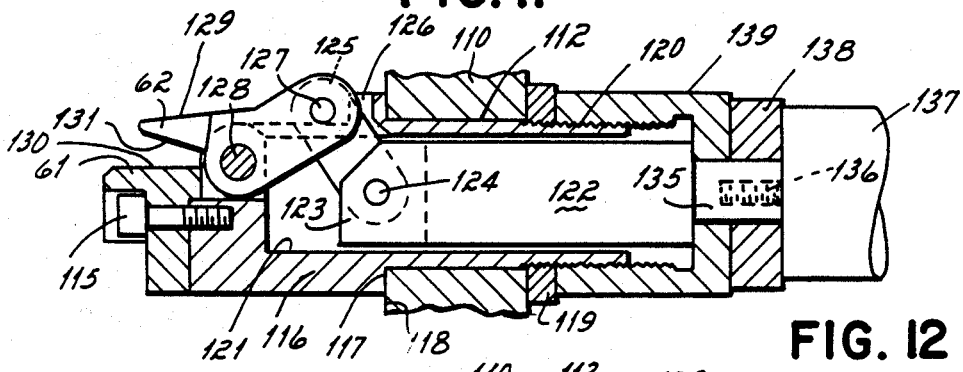
FIG. 12 is a cross-sectional view taken on line 12—12 of FIG. 10.

With reference to FIGS. 10 and 12, there is illustrated the clamping jaw 61, 62 for clamping and flattening the endmost loop or turn of a coil and for holding that endmost loop while the connector section 30 is formed.

With reference particularly to FIG. 12 it will be seen that the jaw 61 is fixedly mounted as by a bolt 115 onto the end of a generally tubular sleeve 116. This sleeve 116 is mounted in the bore 112 of the body 110. It has a shoulder 117 engageable with a face 118 of the body 110. Additionally, it has a threaded section extending through the bore upon which a nut 119 is threaded. When this nut 119 is tightened onto the threaded section 120 of the sleeve 116, it results in clamping of the sleeve within the body 110. Within the sleeve 112 there is an axial bore 121. A piston 122 is slidable within the bore 121 of the sleeve 112. The inner end 123 of this piston 122 is pivotally attached by a shaft 124 to one end of a die actuating link 125. The opposite end of this link 125 extends through a slot 126 of the sleeve 112 and is pivotally attached to a bifurcated end section of the die 62 by a shaft 127. Intermediate the ends of the die 62, it is pivotally mounted within the slot 126 of the sleeve 112 upon a shaft 128. The nose or clamping section 129 of the die 62 extends forwardly from the die over the flat clamping surface 130 of the die 61. The connection of the piston 122 and link 125 to the die is such that as the piston 122 is moved forwardly or inwardly, the nose portion 129 of the die 62 is caused to move downwardly toward the surface 130 of the die 61. If a wire is located between the dies 61, 62, actuation of the die 62 results in clamping the wire between the dies and flattening of it between the flat surface 131 of the die 62 and the flat surface 130 of the die 61.

In order to actuate the piston 122, it has a shaft 135 extending rearwardly therefrom and joined to an output shaft 136 of a hydraulic motor or so-called hydraulic cylinder 137. The connection is such that actuation of the hydraulic cylinder effects reciprocating movement of the piston 122. The hydraulic cylinder 137 is connected by a spacer 138 to a cap 139. The cap 139 is internally threaded onto the external threads 120 of the sleeve 112. Consequently, the hydraulic cylinder is supported from the sleeve 112, which is in turn supported from the body 110 of the forming head 45.

Figure 13:
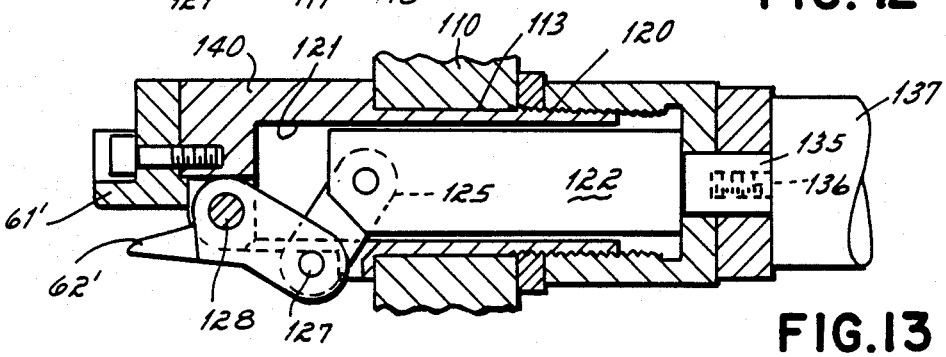
FIG. 13 is a cross-sectional view taken on line 13—13 of FIG. 10.
Figure 14:
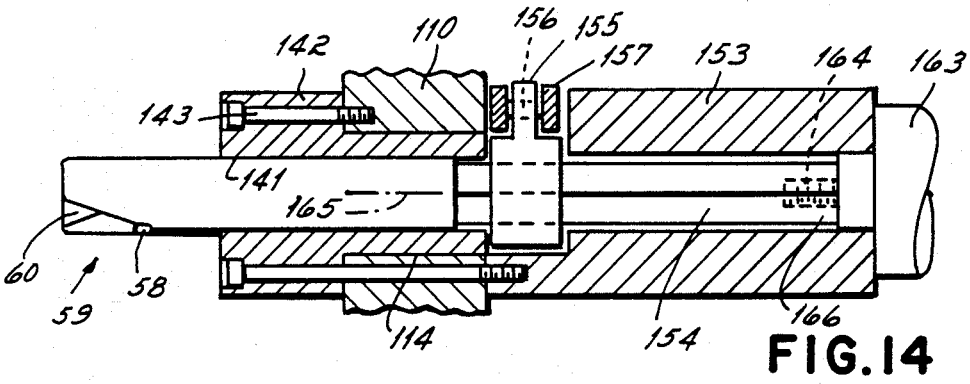
FIG. 14 is a cross-sectional view taken on line 14—14 of FIG. 10.

The dies 61', 62' of the sleeve 140 mounted within the bore 113 of the body 110 are mounted in the same manner (except inverted) and actuated in the same manner as the dies 61, 62 of the sleeve 116. Those dies 61', 62' and the mechanism for actuating them are illustrated in FIG. 13 wherein the remaining components of the dies and actuating mechanism which are identical to those for actuating the dies 61, 62 have been given corresponding numerical designations.

The center bar forming die 59 is rotatably mounted within a bore 141 of a sleeve 142 and axially slidable therein. This sleeve is mounted within the bore 14 of the body 110. The sleeve 142 is secured to the body 110 by bolts or other conventional connectors 143. Additionally, there is bolted to the outboard side of the body 110 another sleeve 153 which is coaxially aligned with the sleeve 142. A square cross section extension 154 is slidable within this outboard sleeve 153. Axial movement of center forming bar 59 is effected by a hydraulic motor or cylinder 163, the cylinder of which is fixed onto the end of the sleeve 153. A piston rod 164 of motor 163 is threaded into the end 166 of the square extension 154 of the center forming bar 59. As a consequence of this connection, hydraulic motor 163 is operable to effect axial movement of the forming bar 59.

Nonrotatably keyed to the ouboard square cross-section extension 154 of the forming bar 59 is a center bar actuating arm 155. This arm has attached to it by a pin 156 a bifurcated arm 157. As seen in FIG. 10, the arm 157 extends downwardly from a piston rod 158 of a hydraulic cylinder 160. The cylinder 160 is in turn mounted upon the body 110 by a supporting bracket 161, which bracket is bolted or otherwise fixedly secured to the body 110 by bolts 162.

As will now be readily apparent, when the piston rod 158 of the hyraulic cylinder 160 is caused to move outwardly from the cylinder, it carries the bifurcated yolk or end 157 outwardly, thereby causing the arm 155 to be rotated about the axis 165 of the center bar 59. This has the effect of rotating the center bar 59 so as to initially entrap the center section of the connector segment 42 within the groove 58 of the center bar and upon subsequent rotary movement of the center bar to form the flat offset 67 in the connector segment. In order to accommodate rotational movement of the arm 155 about the axis 165 of the center bar 59, the cylinder 160 is suspended from a pivot shaft 167, which is in turn mounted in the bracket 161. Thereby, the cylinder is free to move in an arcuate path about the shaft 167 so as to accommodate lateral or transverse movement of the piston rod and attached yolk 157 of the cylinder 160.

In order to accommodate movement of the forming heads 45, 45' inwardly toward the longitudinal axis 46*a* of the conveyor 46 and away from that center line, each of the forming heads 45, 45' is mounted upon a slide 170, which is in turn transversely movable toward and away from the center line 46*a* of the conveyor 46, over a slideway 174 attached to the side rails 111 of the machine 9. To effect this transverse movement of the forming heads, there is a pneumatic motor or cylinder 171 mounted to the frame 111 outboard of the side rails 103. This cylinder 171 has a piston 172 attached by a vertical connector 173 to the slide 170. As a consequence of this connection, actuation of the cylinder 171 effects movement of the forming head toward and away from the center line 46*a* of the conveyor 46.

Coil Row Pickup and Discharge Chute

Figure 16:
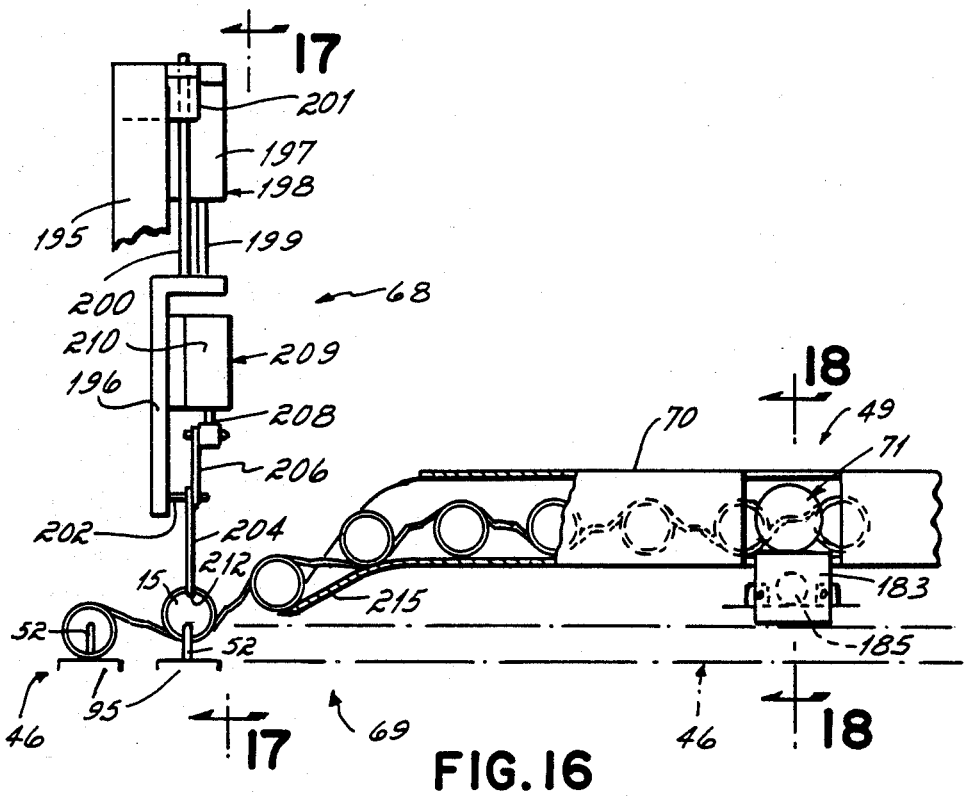
FIG. 16 is an enlarged side elevational view, partially broken away, taken on line 16—16 of FIG. 4 illustrating the take-off station and cutting station.
Figure 17:
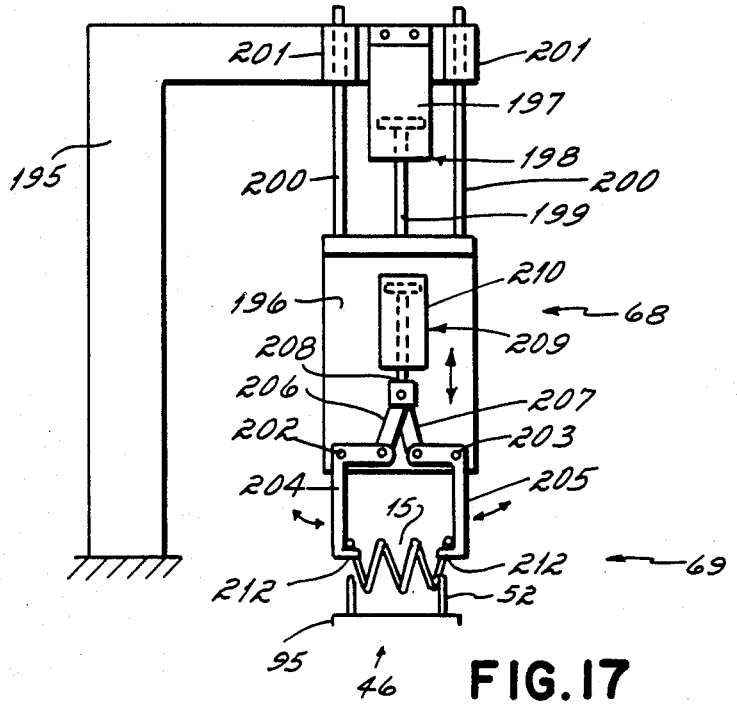
FIG. 17 is a cross-sectional view of the take-off mechanism taken on line 17—17 of FIG. 16.

With reference now to FIGS. 16 and 17, there is illustrated the lifter mechanism 68 for effecting movement of the formed coils 15 off of the supporting pins 52 of the conveyor 46. This lifter mechanism 68 is supported from an overhead arm 195 of the machine frame 111. This arm supports a vertically movable slide 196 of the lifter mechanism. To effect this vertical movement and to support the slide 196 from the arm, a cylinder 197 of a pneumatic motor 198 is fixedly attached to the overhead arm 195. A piston rod 199 of the pneumatic motor 198 is attached to the upper end of this slide 196. The slide has guide rods 200 extending upwardly therefrom and movable through bearings 201 fixedly attached to the arm 195. As a consequence of this attachment of the slide 196 to the arm 195 of the frame, actuation of the pneumatic motor 198 is operative to effect vertical movement of the slide 196 relative to the chain conveyor 46 and the formed coils carried on that conveyor.

Pivotally mounted on the lower end of the slide 196 upon pivot pins 202, 203, there are a pair of C-shaped clamping fingers 204, 205. The upper ends of these clamping fingers are pivotally attached to pivot links 206, 207, respectively. The upper ends of these pivot links are in turn pivotally attached to the lower end of a piston rod 208 of a pneumatic motor 209. The cylinder 210 of this motor 209 is fixedly mounted upon the slide 196. As a consequence of the pivot connection between the pneumatic motor 209 and the C-shaped clamping fingers 204, 205, actuation of the motor 209 is operative to move the inwardly turned lower ends 212 of the fingers 204, 205 into the barrels of the coils 15 and into engagement with the opposite ends of the coils.

In operation of the lifter mechanism, the pneumatic motor 198 is caused to move the slide 196 downwardly while the lower ends 212 of the fingers are in their outermost position. In this position of the fingers, the finger ends 212 move downwardly over the coils and into alignment with the barrels thereof. At the lower end of the movement of the slide 196, the pneumatic motor 209 is actuated so as to cause the fingers to be pivoted about the pivot shafts 202, 203, and thereby moved into the barrel of a formed coil. The motor 198 is then actuated so as to lift the formed coil off of the pins 52. Therefore, the motor 209 is actuated so as to open the fingers 204, 205 and disengage them from the formed coil. With the formed coils lifted off of the pins, the coils are free to move up a ramp 215 and into the discharge chute 80.

Cutting Station

After the rows of coils have had the connector segments thereof formed in the connector forming station 37 and the completely formed coils have been moved by the lifter mechanism or pick-up head 68 off of the pins of the conveyor at take-off station 69 and onto the discharge chute 70, the rows are indexed downstream within the discharge chute 216. In the course of moving downstream within the discharge chute, the rows pass the cutting station 49. This cutting station is connected to a counter (not shown) operative to cause the cutter 71 located at the cutting station 49 to move inwardly and to cut a connector segment between adjacent coils of a row of coils only after a preselected number, as for example fifteen coils, have passed the cutting station. At that point, the cutter 71 located at this station is operative to move into engagement with the connector segment of a pair of connected coils and to cut that connector segment, thereby disengaging the row of coils on the downstream end of the cutter from the upstream row of formed and partially formed coils.

Figure 18:
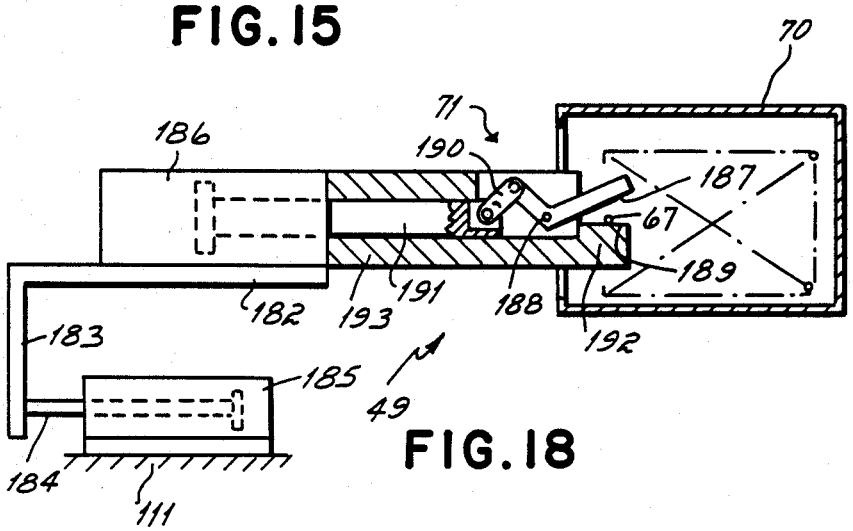
FIG. 18 is a cross-sectional view of the cutting mechanism taken on line 18—18 of FIG. 16.

As best seen in FIGS. 17 and 18, the cutter mechanism 71 is mounted upon slide 182 which is movable over the frame member 111 of machine 9. Although not shown, there is a conventional slideway connection between the frame 181 and the slide 182 supported thereon. The slide 182 is connected by a depending bracket 183 to a piston rod 184 of a pneumatic cylinder 185. This cylinder is mounted upon the frame of the machine and is operative to effect movement of the cutter mechanism toward and away from the center line 46*a* of the conveyor 46.

Mounted atop the slide 182 there is a hydraulic motor or so-called hydraulic cylinder 186 operative to actuate the cutter blade 187 of the cutter mechanism 71. The cutter blade 187 of the cutter mechanism 71 is shaped as a bell crank pivotable about a pivot post 188 at the center of the crank-shaped cutter. The opposite end of the bell crank-shaped cutter from the cutting surface 189 is connected by a link 190 to the piston rod 191 of the hydraulic cylinder 186. The connection is such that actuation of the hydraulic cylinder causes the piston rod to be drawn into the cylinder and the cutter blade to be moved downwardly into a slot of an anvil 192 mounted on the outer end of an anvil supporting sleeve 193. This sleeve is fixedly attached to the hydraulic cylinder 186 and provides a guide for the rod 191 and a mount for the pivot 188. Any wire entrapped between the cutting surface 179 of the cutter blade 177 and the anvil 182 is thereby cut by the blade.

After cutting or severing of adjacent coils between a completed row of coils downstream from the cutting station 171 and a partially formed row upstream of the cutter station, the completed row is transported in the chute 70 away from the machine.

After removal of the row of completely formed coils from the conveyor by the pick-up mechanism 68, the links 53 of the conveyor are moved from their parallel relationship to a linear relationship as a result of the convergence of the cam tracks 100 below the chute 70 and the cutting station 49. As those cam tracks 100 converge, the cam follower rollers 104 attached to the cam follower plates 55 are caused to converge. Convergence of those cam follower rollers 104 and attached plates 55 results in the pivot posts 54 interconnecting the links being moved into a generally linear relationship.

Once located in a linear relationship, the linearly aligned links 53 are caused to move around the forward feed sprocket 47 and are transported in the linearly aligned relationship back to the rear feed sprocket 48.

Operation

Wire formed into a helix of constant diameter and constant pitch is fed from the coiler 43 into the feed tube or trough 50. The constant diameter, constant pitch helically formed wire coil 40 emerges from the tube 50 through the oscillating trough 51 onto the conveyor 46 of the machine 9. As may be seen most clearly in FIGS. 5 and 6, the helically wound wire emerges from the underside of the trough 51 which is open at the forward end. At the forward end of the trough 51, the helically wound wire is picked up by the pins 52 mounted on the links 53 of the chain conveyor 46 as the links are indexed forwardly and as the links pass around the rear feed sprocket 48. The links and the posts upon which the links are mounted are generally arranged in linear alignment as the links move around the sprocket 48 and start downstream away from the sprocket. In actuality, the pins 52 are staggered slightly out of linear alignment so as to enable the pins to better maintain contact with the helically formed wire 40.

When the pin supporting links 53 pass around the sprocket 48 and as the links start downstream away from the sprocket, the pivot posts 54 upon which the links are mounted are also in linear parallel alignment in a common vertical plane as controlled by the cam follower plates 55. As may be most clearly seen in FIG. 7, one end of these triangular-shaped cam follower plates 55 is pivotally supported upon the pivot posts 54. The other end of the cam follower plates 55 remote from the pivot posts has cam follower rollers mounted thereon movable within channels 101, 107 of a cam follower track 100 located on opposite sides of the conveyor 46. These cam follower rollers and the cam follower track 100 cooperate to maintain the cam follower posts 54 in a common vertical plane as the pivot posts move around the rear feed sprocket 48 and start downstream away from the rear feed sprocket. As the links move downstream, though, the cam follower plates 55 and their rollers 104 cause the pivot posts, and thus the links, to be moved from a generally linearly aligned configuration into a parallel configuration. In the course of moving into the parallel configuration, the helical wire 40 supported upon the pins 52 of the links is caused to be formed into a square wave configuration 41 (FIG. 7). In the course of moving into this square wave configuration, the connector segments 42 of the wire located between adjacent parallel coils of the helically wound wire are moved into a generally looped three-dimensional configuration.

After being moved into the square wave configuration, the multiple parallel coils of the square wave configured helix are moved into the connector segment forming stations 37 having forming heads 45, 45' located on opposite sides of the conveyor 46.

It is important to note that the indexing movement of the rear feed sprocket 48, the front drive sprocket 47, the oscillatory movement of the feed trough 51, and the numerous movements of the forming heads 45, 45', as well as the movements of the pick-up assembly 69 and the cutting assembly 71 at the cutter station 49, are all controlled from a common drive shaft which extends the length of the conveyor 46. This drive shaft, as well as the coiler 43, are driven from a common motor. As a consequence, the movement of the coiler, as well as all of the movements of the coil row forming machine 9, are mechanically synchronized. In the case of the pneumatic and hydraulic motors which effect movement of the forming heads 45, 45', as well as the components of those forming heads, and the pneumatic motors which control movement of the lifter mechanism 68, as well as the pneumatic and hydraulic motors which control actuation of the cutter assembly 71, those motors are all controlled from rotary cams driven off of the common drive shaft of the machine. Since such drive shafts and cam actuations of pneumatic and hydraulic motors are common and are conventionally utilized for synchronizing conveyorized machines, the drive system of the machine 9 has not been illustrated and described in detail herein. Persons skilled in this art, though, will readily appreciate how such a drive system operates and is utilized to effect this kind of synchronized control.

Figure 9:
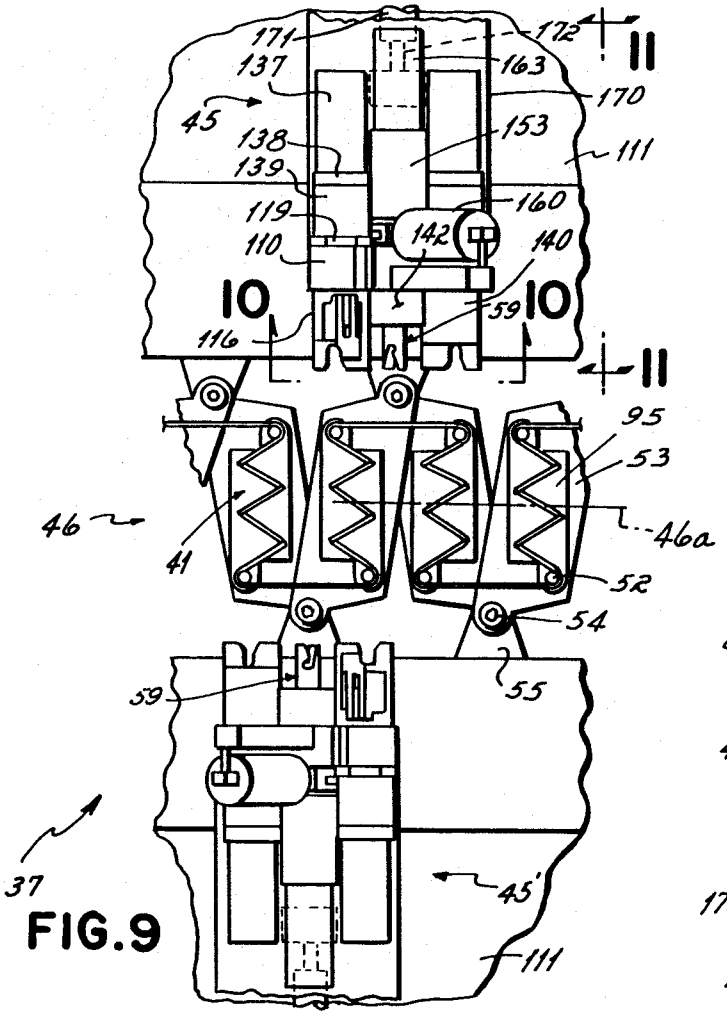
FIG. 9 is an enlarged top plan view of the forming station of the apparatus of FIG. 4.
Figure 9A:
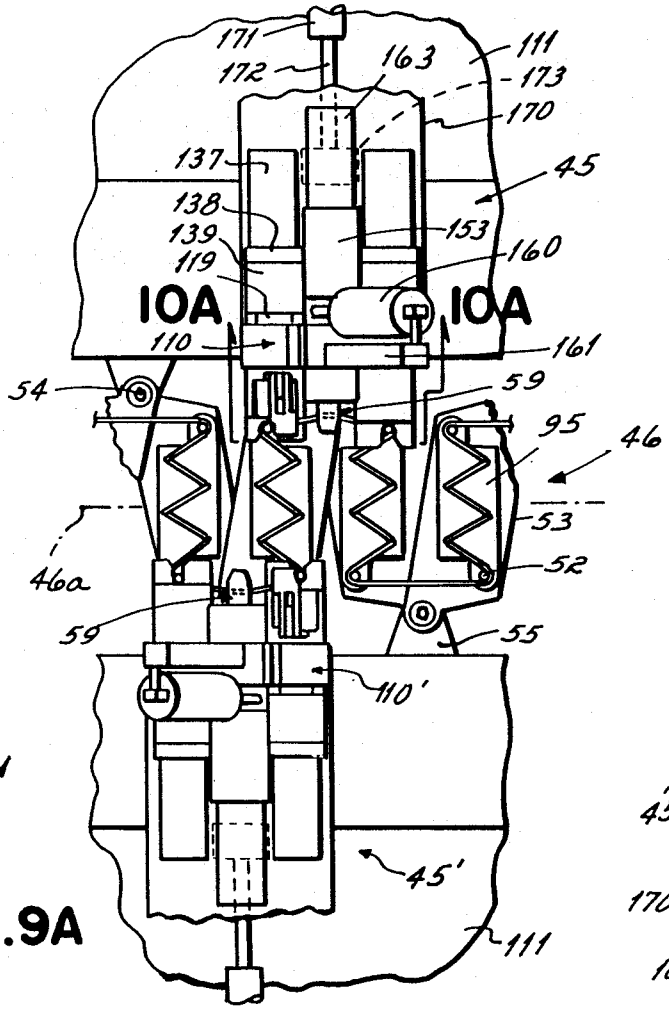
FIG. 9A is a top plan view similar to FIG. 9 but illustrating the forming station after engagement of the forming heads on opposite sides of the row of coil springs with a pair of connector segments of the row of coil springs.
Figure 11:
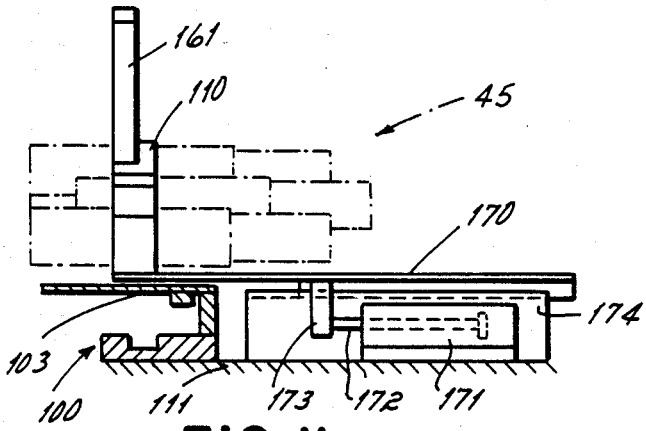
FIG. 11 is a cross-sectional view taken on line 11—11 of FIG. 9.

At the connector forming station 37, a connector segment 42 of two adjacent coils is aligned with one forming head 45, while another connector segment 42' at the opposite end of the coils is aligned with the other forming head 45' on the opposite side of the conveyor 46. Upon completion of the indexing movement of the conveyor to align the connector segments 42 with these forming heads 45, 45', the two heads are caused to move inwardly toward the center line **46*a* of the conveyor. This initial inward movement of the forming heads is effected by the pneumatic motors 171 (FIG. 11) and is operable to position the stationary clamping die 61 of each pair of clamping dies 61, 62 internally of the end loop of a coil with the movable die 62 located over the stationary die 61. With the forming heads so positioned (FIG. 3A), the hydraulic motor 163 associated with the center bar forming die 59 is actuated so as to cause the center bar to move inwardly and position the center section of the connector segment within the V-shaped groove 60 of the center bar 59. The hydraulic motor 160 is then actuated so as to cause the center bar to be rotated through an angle of approximately 15°. This rotational movement results in the center section of the connector segment 42 being entrapped within the groove 58 of the center bar 59. With the center section of the connector segment so entrapped (3B), the center bar is retracted (FIG. 3C) by actuation of the hydraulic motor 163 so as to move the center section of the center bar outwardly as illustrated in FIG. 9A. Thereafter, the hydraulic motors 137 associated with each of the clamping dies 62 are actuated so as to cause the clamping dies to move inwardly toward the axis of the coils and thereby form flats 36 on the endmost loop of each coil. While the forming dies 62 remains closed relative to the fixed die 61 with the flat 36 of the end loop of the coils clamped therebetween, the center bar 59 is rotated through an additional approximately 30° of rotation so as to form the offset 67 in the center section of the connector segment between the two generally parallel end sections 65, 66 (FIG. 3E). The hydraulic motors 137 are next actuated so as to move the movable clamping jaws outwardly away from the fixed dies 61 enough to relieve the pressure on the flats 36 of the endmost loops of the coils. The center forming bar 59 of the forming head is then moved inwardly toward the center line 46***a* of the conveyor 46 by the motor 163 to generally flatten the connector segment 30 (FIG. 3F). The center bar is then rotated counter to the direction in which it rotated to form the offset 67 in the connector segment. This rotation is through an angle of approximately 15° so as to align the offset section 67 of the connector segment with the bottom of the V-shaped groove 60 in the center bar. Simultaneously, the movable forming die 62 is moved by the motors 137 away from the fixed die 61 to its fully opened position. Thereafter, the center bar 59 is fully withdrawn by the motor 163, and each of the forming heads 45, 45' is withdrawn or moved away from the center line of the conveyor 46 so as to enable the conveyor 46 to be indexed to locate the next two connector segments 42 in alignment with the forming heads 45, 45' respectively.

In the course of movement downstream from the forming heads 45, 45', the fully formed coils move beneath the lifter mechanism 68 at the take-off station 69. At this station the pneumatic motor 198 (FIGS. 16 and 17) is actuated so as to cause the slide 196 and the fingers 204, 205 mounted thereon, to move downwardly so as to position the lower ends 212 of the fingers in the horizontal plane of the barrel of a formed coil. The pneumatic motor 209 mounted upon the slide 196 is then actuated so as to cause the ends 212 of the fingers to be moved into the barrel of a formed coil located at the take-off station. The motor 198 is then actuated so as to lift the slide 196 and fingers 204, 205 upwardly and thereby pull the formed coil off of the pins 52. Thereafter, the motor 209 is actuated to move the fingers outwardly and out of the barrel of the formed coil, which has now been lifted off of the pins 52 of the conveyor. The formed coil then moves into the discharge chute 70 (FIG. 16) as the conveyor 46 is indexed.

Figure 15:
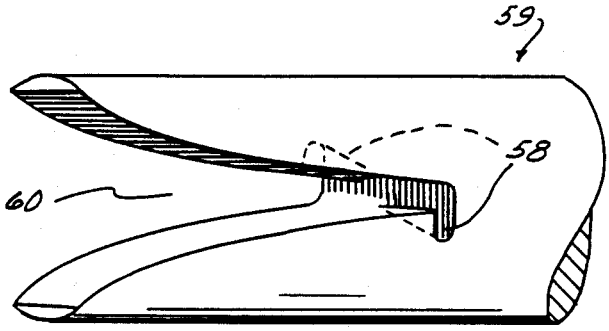
FIG. 15 is an enlarged perspective view of the forming tool of one forming head.

After a preselected number of connector segments have moved through the discharge chute 70 past the cutting station 49, the cutter mechanism 71 located at the cutting station 49 is actuated. In the course of this actuation, the pneumatic motor 185 (FIG. 15) is operated so as to move the cutting edge 189 over a formed connector segment 30. Thereafter, the hydraulic cylinder 186 is actuated so as to cause the edge 189 to move downwardly toward and through a slot in the anvil 192, thereby severing the connector segment between two adjacent coils of the row of coils. The severed row of coils downstream from the cutting station is then removed from the discharge chute.

After pickup of the formed coils and connector segments from the pins 52 of the conveyor by the pick-up mechanism 69, the pin supporting links of the conveyor are caused to be moved back into linear alignment as depicted in FIG. 4 as the links are further indexed downstream from the pick-up station. The links then pass around the forward feed sprocket 47 back to the rear feed sprocket 48 for reception of additional helically formed wire from the coiler 43.

While we have described only a single preferred embodiment of our invention, persons skilled in this art will appreciate changes and modifications which may be made without departing from the spirit of our invention. Therefore, we do not intend to be limited except by the scope of the following appended claims:

We claim:

1. A method of forming a row of spring coils from a single continuous length of wire, said method comprising forming a helix of continuous length from said continuous length of wire, said helix having a longitudinal axis, positioning said continuous length of helix onto a plurality of pins, said pins extending generally normal to the axis of said helix, thereafter folding said continuous length helix into a wave-like configuration by moving selected adjacent pairs of said pins further apart while simultaneously moving pins located adjacent to said selected pairs of said pins into closer proximity so as to create a plurality of substantially parallel spring coils in a coil row, each of said coils being connected at one end by one connector segment with an adjacent coil to one side thereof and being connected at the other end with an adjacent coil at the other side thereof by another connector segment, and thereafter forming each of said connector segments into a substantially flat configuration.

2. A method of claim 1 wherein each of said coils has a pair of endmost loops, each of said connector segments being formed into a desired substantially flat configuration by clamping endmost loops of adjacent coils at opposite ends of each of said connector segments between pairs of dies and then rotating the center portion of each of said connector segments while the endmost loops of adjacent coils at opposite ends of the connector segments are clamped between said dies so as to create an offset center portion of said connector segments located between substantially parallel but offset opposite end portions of said connector segments.

3. The method of claim 2 wherein said pairs of dies form chordal flats in the end loops of each of said coils.

4. The method of forming a substantially flat connector segment between adjacent coils of a row of parallel coils interconnected by connector segments, said coils of said row of coils each having a pair of endmost loops, said endmost loops of each coil begin connected to an adjacent coil by a connector segment, which method comprises clamping endmost loops of adjacent coils at opposite ends of a connector segment between pairs of clamping dies, engaging the center portion of said connector segment with a forming die, rotating said forming die while engaged with said center portion of said connector segment and while the endmost loops of coils located at the opposite ends of said connector segment remain clamped between said pairs of clamping dies so as to create an offset center portion of said connector segment located between substantially parallel but offset opposite end portions of said connector segment.

5. The method of claim 4 wherein said pairs of clamping dies form chordal flats in the end loops of said coils.

6. Apparatus for forming a row of spring coils from a single continuous length of wire, which apparatus comprises means for forming a helix of continuous length from said continuous length of wire, said helix having a longitudinal axis, means for positioning said continuous length of helix onto a plurality of pins, said pins extending generally normal to the axis of said helix, means for thereafter folding said continuous length helix into a wave-like configuration by moving selected adjacent pairs of said pins further apart while simultaneously moving pins located adjacent to said selected pairs of said pins into closer proximity so as to create a plurality of substantially parallel spring coils in a coil row, each of said coils being connected at one end by one connector segment with an adjacent coil to one side thereof and being connected at the other end with an adjacent coil at the other side thereof by another connector segment, and means for thereafter forming each of said connector segments into a substantially flat configuration.

7. The apparatus of claim 6 wherein said means for forming said connector segments into a substantially flat configuration includes means for clamping endmost loops of adjacent coils at opposite ends of each of said connector segments between pairs of dies and means for rotating a center portion of each of said connector segments while the endmost loops of adjacent coils at opposite ends of the connector segments are clamped between said dies so as to create an offset center portion of said connector segments located between substantially parallel but offset opposite end portions of said connector segments.

8. The apparatus of claim 7 wherein said pairs of dies have flat clamping surfaces thereon operative to form chordal flats on the end loops of each of said coils.

9. Apparatus for forming a substantially flat connector segment between adjacent coils of a row of parallel coils interconnected by connector segments, said coils of said row of coils each having a pair of endmost loops, said endmost loops of each coil being connected to an adjacent coil by a connector segment, which apparatus comprises means for clamping endmost loops of adjacent coils at opposite ends of a connector segment between pairs of clamping dies, means for engaging a center portion of said connector segment with a forming die, means for rotating said forming die while engaged with said center portion of said connector segment and while the endmost loops of coils located at the opposite ends of said connector segment remain clamped between said pairs of clamping dies so as to create an offset center portion of said connector segment located between substantially parallel but offset opposite end portions of said connector segment.

10. The apparatus of claim 9 wherein said pairs of clamping dies have flat clamping surfaces thereon operative to form chordal flats in the end loops of said coils.

11. Apparatus for forming a row of spring coils from a single continuous length of wire, which apparatus comprises means for forming a helix of continuous length from said continuous length of wire, said helix having a longitudinal axis, means for positioning said continuous length of helix onto a plurality of pins, said pins being supported upon links of a conveyor and extending generally normal to the axis of said helix, means for thereafter folding said continuous length helix into a wave-like configuration by moving said links of said conveyor from linear alignment into parallel alignment so as to create a plurality of substantially parallel spring coils in a coil row, each of said coils being connected at one end by one connector segment with an adjacent coil to one side thereof and being connected at the other end with an adjacent coil at the other side thereof by another connector segment, and means for thereafter forming each of said connector segments into a substantially flat configuration.

12. The apparatus of claim 11 wherein said means for forming said connector segments into a substantially flat configuration includes means for clamping endmost loops of adjacent coils at opposite ends of each of said connector segments between pairs of dies and means for rotating a center portion of each of said connector segments while the endmost loops of adjacent coils at opposite ends of the connector segments are clamped between said dies so as to create an offset center portion of said connector segments located between substantially parallel but offset opposite end portions of said connector segments.

13. The apparatus of claim 12 wherein said pairs of dies have flat clamping surfaces thereon operative to form chordal flats on the end loops of each of said coils.

14. The apparatus of claim 11 which further includes means for disengaging said coil row from said pins after forming of said connector segments between adjacent coils of said row, a cutting station, and means at said cutting station for severing a connector segments between adjacent coils of a coil row after a preselected number of coils of said row have moved past said cutting station.

15. The apparatus of claim 14 wherein said means for disengaging said coil row from said pins comprises a reciprocating gripper operative to close about connected coils of said coil row and lift said connected coils from said pins onto a coil row discharge chute.

16. Apparatus for forming a row of spring coils from a single continuous length of wire, which apparatus comprises means for forming a helix of continuous length from said continuous length of wire, said helix having a longitudinal axis, a conveyor, means for positioning said continuous length of helix onto said conveyor, said conveyor including a plurality of links, means for folding said continuous length helix into a wave-like configuration by moving said links of said conveyor from colinear alignment into parallel alignment so as to create a plurality of substantially parallel spring coils in a coil row, each of said coils being connected at one end by one connector segment with an adjacent coil to one side thereof and being connected at the other end with an adjacent coil at the other side thereof by another connector segment, and means for thereafter forming each of said connector segments into a substantially flat configuration.

17. The apparatus of claim 16 wherein said means for forming said connector segments into a substantially flat configuration includes means for clamping endmost loops of adjacent coils at opposite ends of each of said connector segments between pairs of dies and means for rotating a center portion of each of said connector segments while the endmost loops of adjacent coils at opposite ends of the connector segments are clamped between said dies so as to create an offset center portion of said connector segments located between substantially parallel but offset opposite end portions of said connector segments.

18. The apparatus of claim 16 which further includes means for disengaging said coil row from said positioning means after forming of said connector segments between adjacent coils of said row, a cutting station, and means at said cutting station for severing a connector segment between adjacent coils of a coil row after a preselected number of coils of said row have moved past said cutting station.

19. The apparatus of claim 16 wherein said conveyor is an endless conveyor movable over sprockets, said sprockets begin rotatable about horizontal axes, and said links of said conveyor being interconnected by vertical connecting pins.

20. The apparatus of claim 19 wherein said connecting pins are connected to said links by universal bearings so as to enable said links to be pivotable both horizontally and vertically relative to adjacent links.

21. The apparatus of claim 20 wherein said conveyor includes cam plates secured to each of said connecting pins, said cam plates including follower means engageable with cam trucks located on opposite sides of said conveyor.

22. The apparatus of claim 21 wherein said cam tracks diverge away from the conveyor to effect movement of said links from colinear alignment into parallel alignment and said cam tracks converge toward said conveyor to effect movement of said links from parallel alignment into colinear alignment.

23. A machine for production rows of coil springs, each of said rows of coil springs being formed from a single continuous piece of wire and each of said rows containing a plurality of coils interconnected by interconnecting segments, alternate ones of said interconnecting segments being disposed in spaced parallel planes, the axes of said coils being disposed perpendicular to said spaced, parallel planes, each of said coils terminating in a chordal flat bar located in a plane of said base and grid, and the chordal flat bars of adjacent coils being interconnected by said interconnecting segments, each of said interconnecting segments having substantially parallel end portions connected at the center by an offset section, said machine comprising conveyor means for transporting connected rows of coils through said machine, forming means for forming said chordal flats and said interconnecting segments between said coils, said forming means being synchronized with movement of said conveyor so as to enable said flats and interconnecting segments to formed, while said rows of coils are supported upon said conveyor.

24. The machine of claim 23 which further comprises cutting means located downstream of said forming means for severing an interconnecting segment between adjacent coils after a predetermined number of said coils have moved past said cutting means.

25. A machine for producing rows of coil springs, each of said rows of coil springs being formed from a single continuous piece of wire and each of said rows containing a plurality of coils, each of said coils terminating in end loops, the end loops of adjacent coils being interconnected by interconnecting segments, alternate ones of said interconnecting segments being disposed in spaced parallel planes, the axes of said coils being disposed perpendicular to said spaced, parallel planes, each of said interconnecting segments having substantially parallel end portions connected by an offset portion, said machine comprising conveyor means for transporting connected rows of coils through said machine, forming means for forming said interconnecting segments within said machine and while said coils are being transported upon said conveyor, said forming means being synchronized with movement of said conveyor through said machine.

26. The machine of claim 25 which further includes means located downstream of said forming means for removing said coils from said conveyor after formation of said interconnecting segments by said forming means.

27. The machine of claim 26 which further includes cutting means for severing an interconnecting segment between adjacent coils after a predetermined number of said coils have moved past said cutting means so as to create rows of disconnected coils containing said predetermined number of coils.

28. A method of forming a row of spring coils from a single continuous length of wire, said method comprising forming a helix of continuous length from said continuous length of wire, said helix having a longitudinal axis, folding said continuous length helix into a wave-like configuration so as to create a plurality of substantially parallel spring coils in a coil row, each of said coils being connected at one end by one connector segment with an adjacent coil to one side thereof and being connected at the other end with an adjacent coil at the other side thereof by another connector segment, and thereafter forming each of said connector segments into a substantially flat configuration by clamping opposite ends of each of said connector segments between pairs of dies and then rotating the center portion of each of said connector segments while the opposite ends of the connector segments are clamped between said dies so as to create an offset center portion of said connector segments located between substantially parallel but offset opposite end portions of said connector segments.

29. The method of claim 28 wherein said pairs of dies form chordal flats in the end loops of each of said coils.

30. The method of forming a substantially flat connector segment between adjacent coils of a row of parallel coils interconnected by connector segments, said coils of said row of coils each having a pair of endmost loops, said endmost loops of each coil being connected to an adjacent coil by a connector segment, which method comprises clamping opposite ends of a connector segment between pairs of clamping dies, engaging the center portion of said connector segment with a forming die, rotating said forming die while engaged with said center portion of said connector segment and while the opposite ends of said connector segment remain clamped between said pair of clamping dies so as to create an offset center portion of said connector segment located between substantially parallel but offset opposite end portions of said connector segment.

31. A machine for producing rows of coil springs, each of said rows of coil springs being formed from a single continuous piece of wire and each of said rows containing a plurality of coils, each of said coils terminating in end loops, the end loops of adjacent coils being interconnected by interconnecting segments, alternate ones of said interconnecting segments being disposed in spaced, parallel planes, the axes of said coils being disposed perpendicular to said spaced, parallel planes, each of said interconnecting segments having substantially parallel end portions connected by an offset portion, said machine comprising conveyor means for transporting connected rows of coils through said machine, forming means for forming said interconnecting segments within said machine and while said coils are being transported upon said conveyor, said forming means being synchronized with movement of said conveyor through said machine, said forming means being operable to form said interconnecting segments by clamping opposite ends of said interconnecting segments and then rotating the center portion of said interconnecting segments.

* * * * *

UNITED STATES PATENT AND TRADEMARK OFFICE

CERTIFICATE OF CORRECTION

PATENT NO. : 4,726,106

DATED : February 23, 1988

INVENTOR(S) : Henry G. Mohr

It is certified that error appears in the above-identified patent and that said Letters Patent is hereby corrected as shown below:

Column 1, line 44, "sring" should be -- spring -- .

Column 2, line 63-64, "predicted" should be -- predicated -- .

Column 3, line 3, "predicted" should be -- predicated -- .

Column 3, line 15, "predicted" should be -- predicated -- .

Column 3, line 38, "formed in" should be --formed into -- .

Column 5, line 22, "coilo" should be -- coil -- .

Abstract line 25 and 26, "connectors" should be -- connector -- .

Column 6, line 29, "applciation" should be -- application -- .

Column 6, line 60, "lanar" should be -- planar --.

Column 7, line 4, "39" should be -- 49 -- .

Column 7, line 33, "alignment In" should be -- alignment. In -- .

UNITED STATES PATENT AND TRADEMARK OFFICE

CERTIFICATE OF CORRECTION

PATENT NO. : 4,726,106

DATED : February 23, 1988

INVENTOR(S) : Henry G. Mohr

It is certified that error appears in the above-identified patent and that said Letters Patent is hereby corrected as shown below:

Column 8, line 57, "fo" should be -- of -- .

Column 8, line 62, "head" should be -- heads -- .

Column 9, line 25, "56." should be -- 56, -- .

Column 9, line 27, "cuttin" should be -- cutting -- .

Column 9, line 42, "fed trough" should be -- feed trough--.

Column 9, line 64, "having a" should be -- having an -- .

Column 10, line 14, "within the" should be -- within that -- .

Column 10, line 19, "of turns of" should be -- of turns or -- .

Column 10, line 35, "sprckets" should be -- sprockets -- .

Column 12, line 52, "bore 141" should be -- bore 114 --.

Column 14, line 21, "chute 80" should be -- chute 70 -- .

Column 20, line 44, "segments" should be -- segment -- .

UNITED STATES PATENT AND TRADEMARK OFFICE

CERTIFICATE OF CORRECTION

PATENT NO. : 4,726,106

DATED : February 23, 1988

INVENTOR(S) : Henry G. Mohr

It is certified that error appears in the above-identified patent and that said Letters Patent is hereby corrected as shown below:

Column 21, line 29, "begin" should be -- being -- .

Column 21, line 47, "production" should be -- producing -- .

Column 21, line 52, "spaced" should be -- spaced, -- .

Column 21, line 67, "to formed" should be -- to be formed -- .

Signed and Sealed this

Twenty-fifth Day of June, 1991

*Attest:*

*Attesting Officer*

HARRY F. MANBECK, JR.

*Commissioner of Patents and Trademarks*